US006782218B2

(12) United States Patent
Sekiguchi et al.

(10) Patent No.: US 6,782,218 B2
(45) Date of Patent: Aug. 24, 2004

(54) IMAGE FORMING APPARATUS HAVING CONTROL SECTION FOR ENABLING/ DISABLING TABBED SHEET PRINT MODE SETTING SECTION, AND CORRESPONDING METHOD AND STORAGE MEDIUM THEREOF

(75) Inventors: Nobuo Sekiguchi, Ibaraki (JP); Rieko Akiba, Kanagawa (JP); Tadaaki Saida, Chiba (JP); Yuichiro Maeda, Ibaraki (JP)

(73) Assignee: Canon Kabushiki Kaisha (JP)

( * ) Notice: Subject to any disclaimer, the term of this patent is extended or adjusted under 35 U.S.C. 154(b) by 85 days.

(21) Appl. No.: 10/092,013

(22) Filed: Mar. 6, 2002

(65) Prior Publication Data

US 2002/0146256 A1 Oct. 10, 2002

(30) Foreign Application Priority Data

Mar. 6, 2001 (JP) ..... 2001-062213
Mar. 5, 2002 (JP) ..... 2002-058565

(51) Int. Cl.[7] ..... G03G 15/00
(52) U.S. Cl. ..... 399/81; 399/382
(58) Field of Search ..... 399/85, 382, 81, 399/82, 8, 84, 83; 358/1.18, 296, 300

(56) References Cited

U.S. PATENT DOCUMENTS 5,049,929 A * 9/1991 Anderson et al. ..... 399/82
5,061,958 A * 10/1991 Bunker et al. ..... 399/81
5,603,060 A * 2/1997 Weinberger et al. ..... 399/8
5,722,029 A * 2/1998 Tomidokoro et al. ..... 399/389
6,393,232 B1 * 5/2002 Osari et al. ..... 399/82
6,549,300 B2 * 4/2003 Motamed et al. ..... 358/1.18
6,571,072 B1 * 5/2003 Sugimoto ..... 399/81

FOREIGN PATENT DOCUMENTS

EP 0479495 A2 * 4/1992 ..... H04N/1/387
JP 2001-166641 A 6/2001

* cited by examiner

*Primary Examiner*—Robert B Beatty
(74) *Attorney, Agent, or Firm*—Rossi & Associates

(57) ABSTRACT

There is provided an image forming apparatus an image forming apparatus that is capable of presetting a tabbed sheet feeding section and the number of divisions of recording sheets by tabbed sheets to make the setting operations easier in a tabbed sheet insert mode and a tabbed sheet producing mode during image formation, thus improving the operability. An image forming section forms images on tabbed sheets each having a tab projecting from one edge thereof. A tabbed sheet print mode setting section sets a tabbed sheet print mode in which an image is formed on the tab of each of the tabbed sheets. A control section enables the tabbed sheet print mode setting section to set the tabbed sheet print mode when a sheet feeding section that stores tabbed sheets and the number of tabbed sheets per set are set in advance.

20 Claims, 26 Drawing Sheets

IMAGE FORMING APPARATUS HAVING CONTROL SECTION FOR ENABLING/ DISABLING TABBED SHEET PRINT MODE SETTING SECTION, AND CORRESPONDING METHOD AND STORAGE MEDIUM THEREOF

BACKGROUND OF THE INVENTION

1. Field of the Invention

This invention relates to an image forming apparatus that is capable of forming images on tabbed sheets each having a tab projecting from one side edge thereof.

2. Description of the Related Art

Conventionally, there has been used an image forming apparatus that is capable of inserting recording sheets of a regular size, which are fed from a sheet feeding section designated for the regular size, into a desired position in recording sheets being copied or printed during one copy job or print job carried out in a mode in which originals are read such as a copy mode or print mode, or in a mode designated according to images written in PDL.

On the other hand, there has been used a copying machine that is capable of designating a position in record sheets of a regular size into which tabbed sheets having tabs (i.e. tabbed sheets having tabs projecting from one side edges thereof) are to be inserted, during one copy job for inserting the tabbed sheets into the recording sheets.

There has been proposed a copying machine that is capable of setting the number of divisions by tabbed sheets, that is, a number corresponding to a number of groups into which recording sheets are divided or grouped by one set of tabbed sheets (i.e. the number of tabbed sheets included in one set that is formed by sequentially stacking tabbed sheets having tabs at different positions; a bundle of a plurality of such sets of tabbed sheets are sold on the market), the shift amount of an image to be printed on a tab, and the like, when setting a tabbed sheet insert mode in which tabbed sheet insert positions are designated.

In a tabbed sheet insert mode or a tabbed sheet producing mode (these modes will be generically referred to as the tabbed sheet print mode) in a conventional copying machine that is capable of handling tabbed sheets, a tabbed sheet feeding section and the number of divisions by tabbed sheets are designated in a sequence of operations for setting the tabbed sheet insert mode and the tabbed sheet producing mode. In this sequence of operations, upon selection of the tabbed sheet insert mode or the tabbed sheet producing mode, 1) a sheet feeding section in which tabbed sheets are stored is designated first, 2) the number of tabbed sheets per set is set, and 3) the shift amount of an image to be printed on the tab of each tabbed sheet is set so that the image can be printed on the tab. Finally, 4) tabbed sheet insert pages are set.

Specifically, every time the tabbed sheet insert mode or the tabbed sheet producing mode is selected, the above mentioned setting operations 1) to 4) are carried out. Accordingly, a sheet feeding section in which tabbed sheets are stored and the number of tabbed sheets per set are set upon every selection of the tabbed sheet insert mode or the tabbed sheet producing mode.

Further, in recent years, there has been developed a digital copying machine that is connected to a network and is capable of giving an instruction for printing images on tabbed sheets if a tabbed sheet feeding section is provided in the case where the digital copying machine is used as a printer.

However, once tabbed sheets are placed in the tabbed sheet feeding section, the number of divisions by tabbed sheets placed on the tabbed sheet feeding section remains unchanged for a considerable time in many cases, and therefore, if the number of divisions by tabbed sheets displayed first is coincident with the number of divisions by tabbed sheets placed in the tabbed sheet feeding section in a sequence of operations for setting the tabbed sheet insert mode or the tabbed sheet producing mode, there is no necessity of changing the number of tabbed sheets per set. However, since the number of divisions by tabbed sheets is actually changeable, it is troublesome to set the number of divisions by tabbed sheets due to the necessity of depressing an OK key.

Further, since the number of divisions by tabbed sheets is set in a sequence of operations for setting a mode such as the tabbed sheet insert mode and the tabbed sheet producing mode, the set number of divisions by tabbed sheets placed in a tabbed sheet feeding section of a copying machine serving as a printer cannot be clearly recognized by a personal computer that is used to print images on the tabbed sheets.

SUMMARY OF THE INVENTION

It is therefore an object of the present invention to provide an image forming apparatus and a method of controlling the same that are capable of presetting a tabbed sheet feeding section and the number of divisions by tabbed sheets to make the setting operations easier in a tabbed sheet insert mode and a tabbed sheet producing mode during image formation, thus improving the operability.

To attain the above object, in a first aspect of the present invention, there is provided an image forming apparatus comprising a plurality of sheet feeding sections, an image forming section that forms images on tabbed sheets each having a tab projecting from one edge thereof, a mode setting section that sets a tabbed sheet print mode in which the image forming section forms an image on the tab of each of the tabbed sheets, and a control section responsive to at least one of the sheet feeding sections that stores the tabbed sheets and a number of the tabbed sheets per set being set in advance, for enabling the mode setting section to set the tabbed sheet print mode.

In a preferred form of the first aspect, the image forming apparatus comprises a sheet feeding setting section that sets the at least one of the sheet feeding sections that stores the tabbed sheets, and a sheet number setting section that sets the number of the tabbed sheets per set stored in the sheet feeding section.

In this preferred form, preferably, the control section is responsive to the at least one of the sheet feeding sections that stores the tabbed sheets being set in advance by the sheet feeding setting section and the number of the tabbed sheets per set being set in advance by the sheet number setting section, for providing control so as to display an input screen for setting the tabbed sheet print mode.

More preferably, the control section provides control so as not to display an input screen for setting the tabbed sheet print mode when none of the sheet feeding sections that stores the tabbed sheets is set in advance by the sheet feeding setting section and the number of the tabbed sheets per set is not set in advance by the sheet number setting section Preferably, the input screen includes a key for setting the tabbed sheet print mode.

Also preferably, the control section provides control so as to display a predetermined number of tabbed sheets per set on a screen displayed in the tabbed sheet print mode without requesting setting of the number of the tabbed sheets per set.

To attain the above object, in a second aspect of the present invention, there is provided an image forming apparatus comprising a plurality of sheet feeding sections, an image forming section that forms images on tabbed sheets each having a tab projecting from one edge thereof, and a mode setting section that sets a tabbed sheet print mode in which the image forming section forms an image on the tab of each of the tabbed sheets, wherein the mode setting section omits to request setting at least a number of the tabbed sheet per set in setting the tabbed sheet print mode when at least one of the sheet feeding sections that stores the tabbed sheets and a number of the tabbed sheets per set are set in advance before setting the the tabbed sheet print mode.

In a preferred form of the second aspect, the image forming apparatus comprises a sheet feeding setting section that sets the at least one of the sheet feeding sections that stores the tabbed sheets, and a sheet number setting section that sets the number of the tabbed sheets per set stored in the sheet feeding section.

In this preferred form, preferably, the mode setting section requests setting the at least one of the sheet feeding sections that stores the tabbed sheets and the number of the tabbed sheets per set in setting the tabbed sheet print mode when the at least one of the sheet feeding sections that stores the tabbed sheets and the number of the tabbed sheets per set are not set in advance before setting the the tabbed sheet print mode.

More preferably, the image forming apparatus according to the second aspect comprises a storage section that stores the at least one of the sheet feeding sections that stores the tabbed sheets and the number of the tabbed sheets per set, set in response to the request by the mode setting section in setting the tabbed sheet print mode.

Still more preferably, when setting of the number of the tabbed sheet per set was requested in setting the tabbed sheet print mode, the mode setting section omits to request_ setting at least the number of the tabbed sheets per set in setting the tabbed sheet print mode next time.

Also preferably, the image forming apparatus according to the second aspect comprises a control section that displays the set number of the tabbed sheets per set on a setting screen in the tabbed sheet print mode.

To attain the above object, in a third aspect of the present invention, there is provided an image forming apparatus comprising an image forming section connected to a terminal device, for forming images on tabbed sheets each having a tab projecting from one edge thereof according to an instruction from the terminal device, an interface section for providing interface between the image forming apparatus and the terminal device, a plurality of sheet feeding sections, a sheet feeding setting section that sets at least one of the sheet feeding sections that stores the tabbed sheets, a sheet number setting section that sets a number of the tabbed sheet per set, and a data presenting section that presents the at least one of the sheet feeding sections that stores the tabbed sheets, set by the sheet feeding setting section and the number of the tabbed sheets per set, set by the sheet number setting section, to the terminal device via the interface section.

To attain the above object, in a fourth aspect of the present invention, there is provided an image forming apparatus comprising an image forming section connected to a network having a plurality of terminal devices, for forming images on tabbed sheets each having a tab projecting from one edge thereof according to an instruction from any of the terminal devices, a network interface section, a plurality of sheet feeding sections, a sheet feeding setting section that sets at least one of the sheet feeding sections that stores the tabbed sheets, a sheet number setting section that sets a number of the tabbed sheets per set, and a data presenting section that presents the at least one of the sheet feeding sections that stores the tabbed sheets, set by the sheet feeding setting section and the number of the tabbed sheets per set, set by the sheet number setting section, to the terminal devices via the network interface section.

Preferably, in the image forming apparatus according to the third or fourth aspect, the data presenting section presents at least the number of the tabbed sheets per set, set by the sheet number setting section, in response to reference from the terminal device.

To attain the above object, in a fifth aspect of the present invention, there is provided a method of controlling an image forming apparatus that forms images on tabbed sheets each having a tab projecting from one edge thereof, comprising the steps of setting a sheet feeding section that stores the tabbed sheets, setting a number of the tabbed sheets per set, setting a tabbed sheet print mode in which an image is formed on the tab of each of the tabbed sheets, and enabling the tabbed sheet print mode to be set, in response to the sheet feeding section that stores the tabbed sheets and the number of the tabbed sheets per set being set in advance.

Preferably the method of controlling an image forming apparatus according to the fifth aspect comprises the step of inhibiting the tabbed sheet print mode from being set when the sheet feeding section that stores the tabbed sheets and the number of the tabbed sheets per set are not set in advance.

To attain the above object, in a sixth aspect of the present invention, there is provided a method of controlling an image forming apparatus that forms images on tabbed sheets each having a tab projecting from one edge thereof, comprising the steps of setting a sheet feeding section that stores the tabbed sheets, setting a number of the tabbed sheets per set, setting a tabbed sheet print mode in which an image is formed on the tab of each of the tabbed sheets, and omitting to request setting at least the number of the tabbed sheets per set in setting the tabbed sheet print mode when the sheet feeding section that stores the tabbed sheets and the number of the tabbed sheets per set are set in advance.

The above and other objects, features and advantages of the present invention will become more apparent from the detailed description taken in conjunction with the accompanying drawings.

Figure 17:
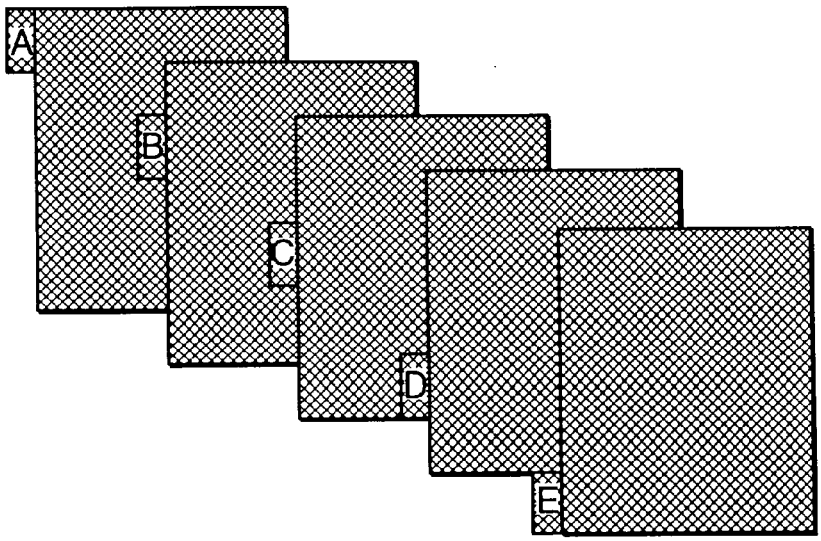
Figure 18:
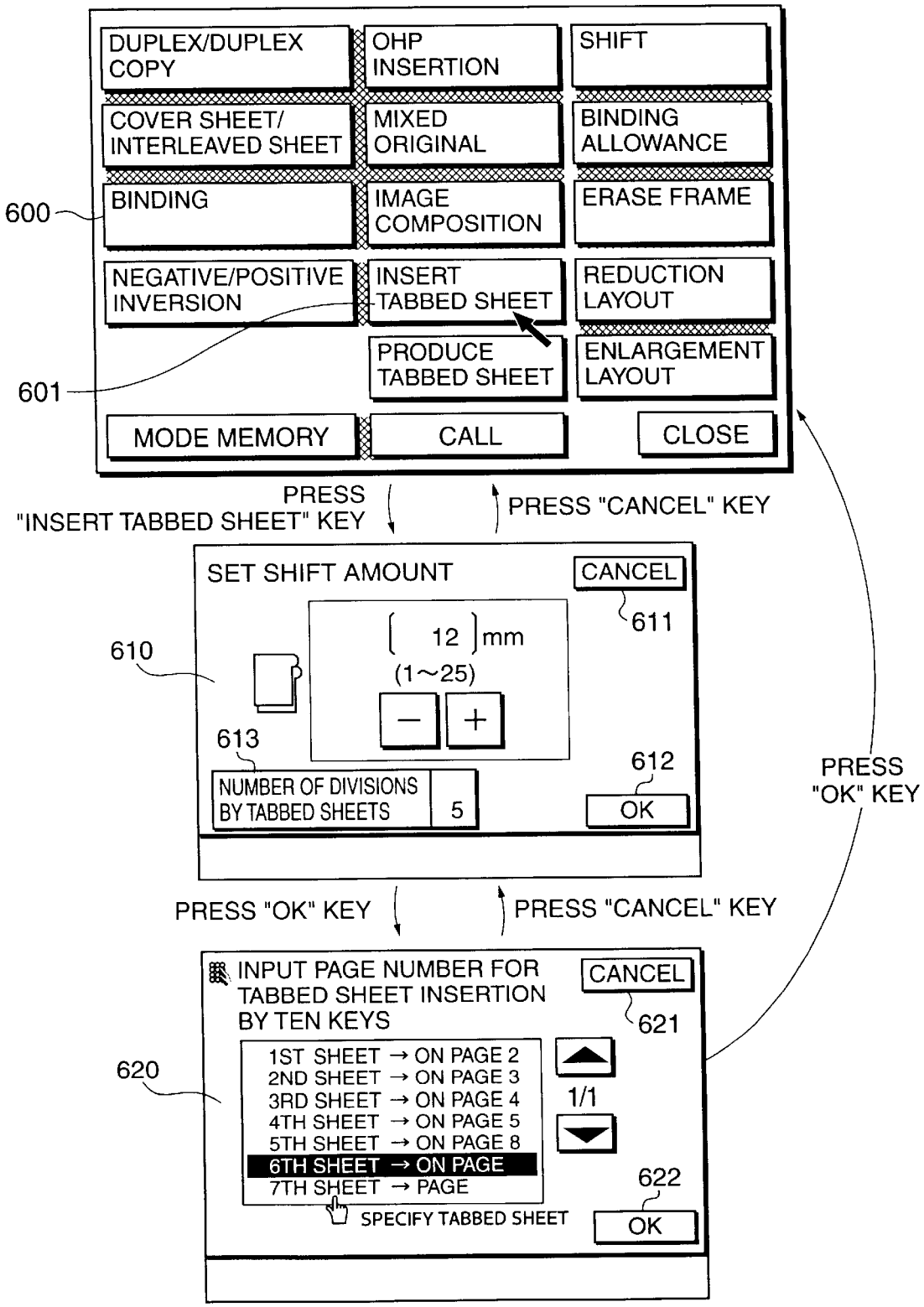
Figure 19:
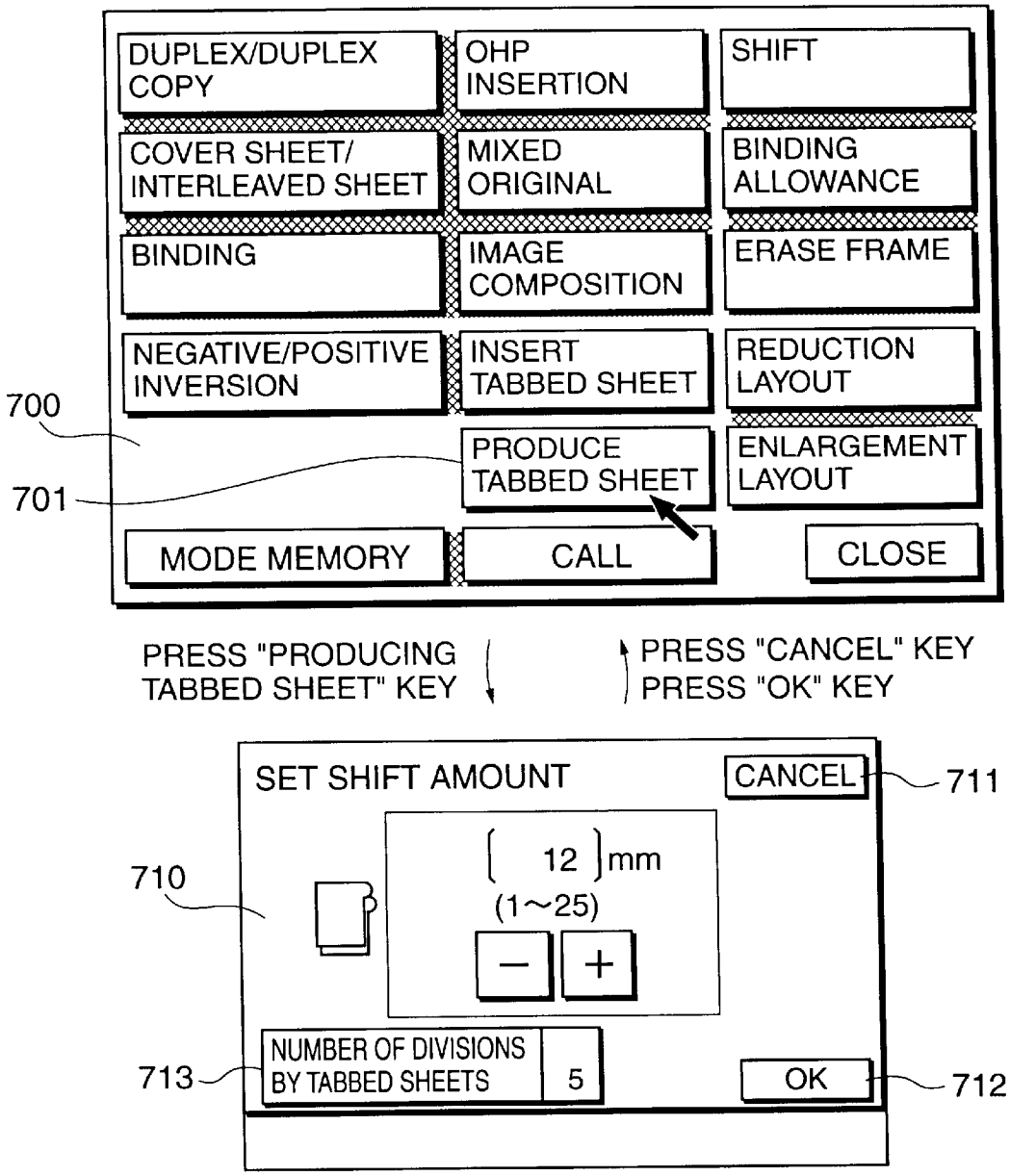
Figure 20:
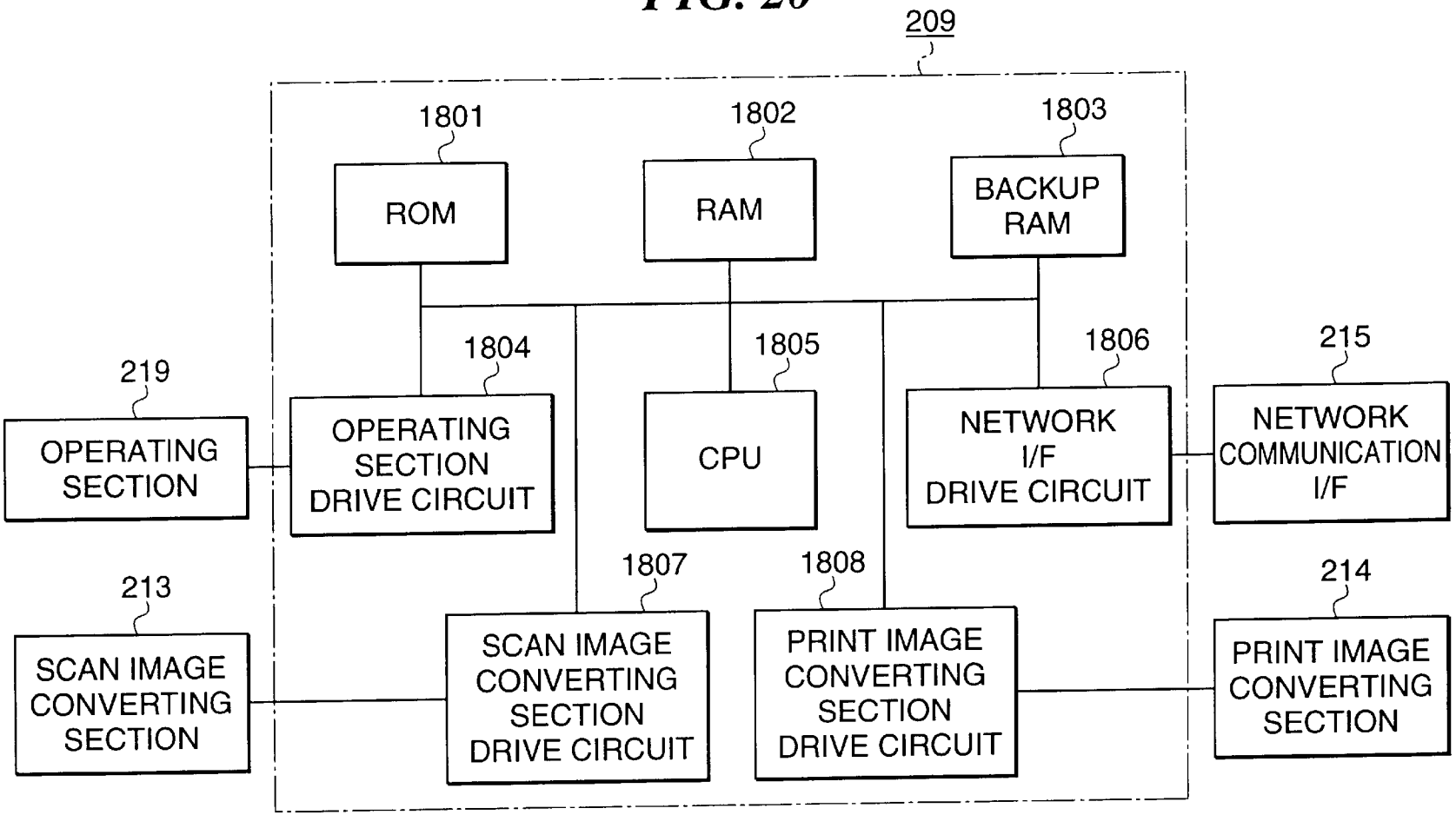
Figure 21A:
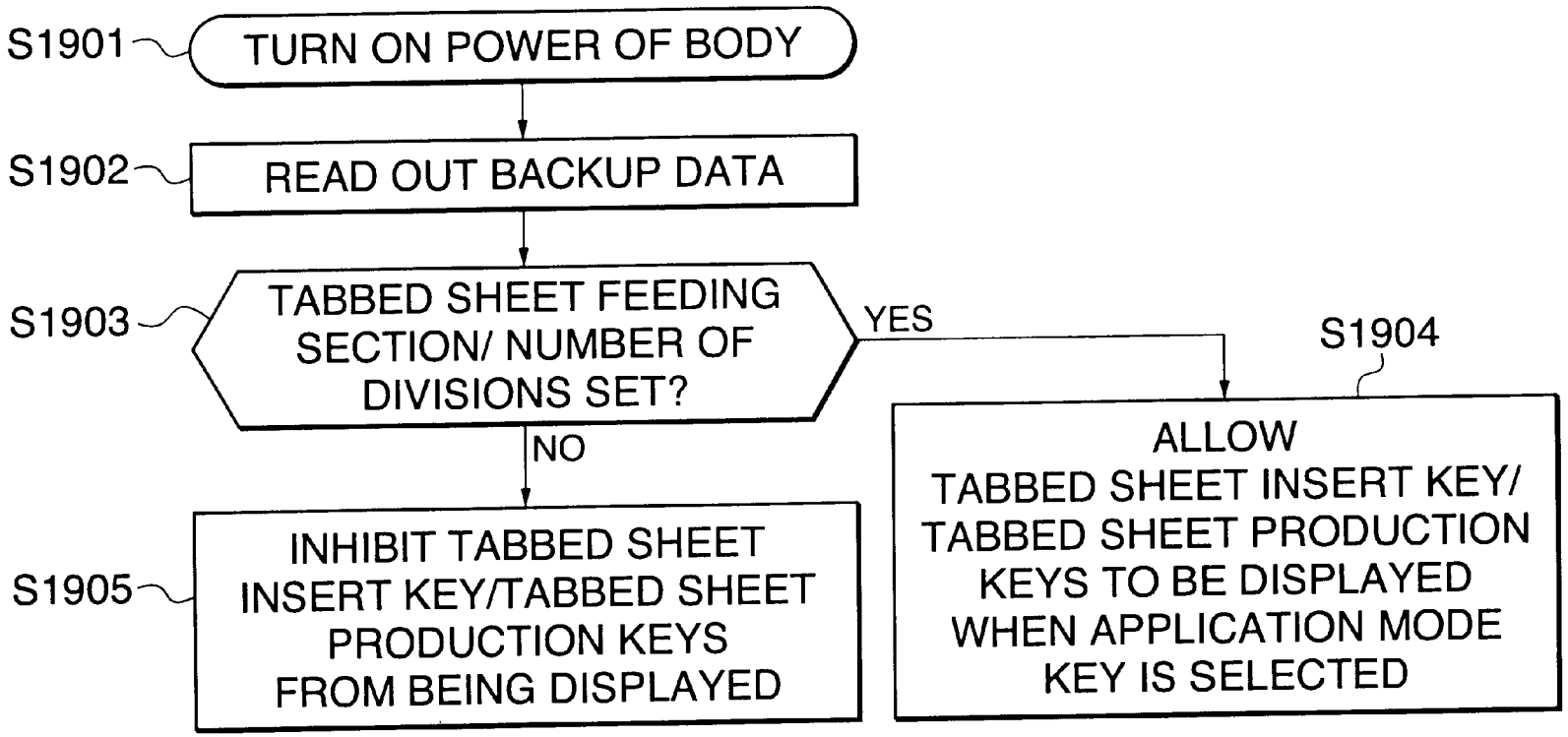
Figure 21B:
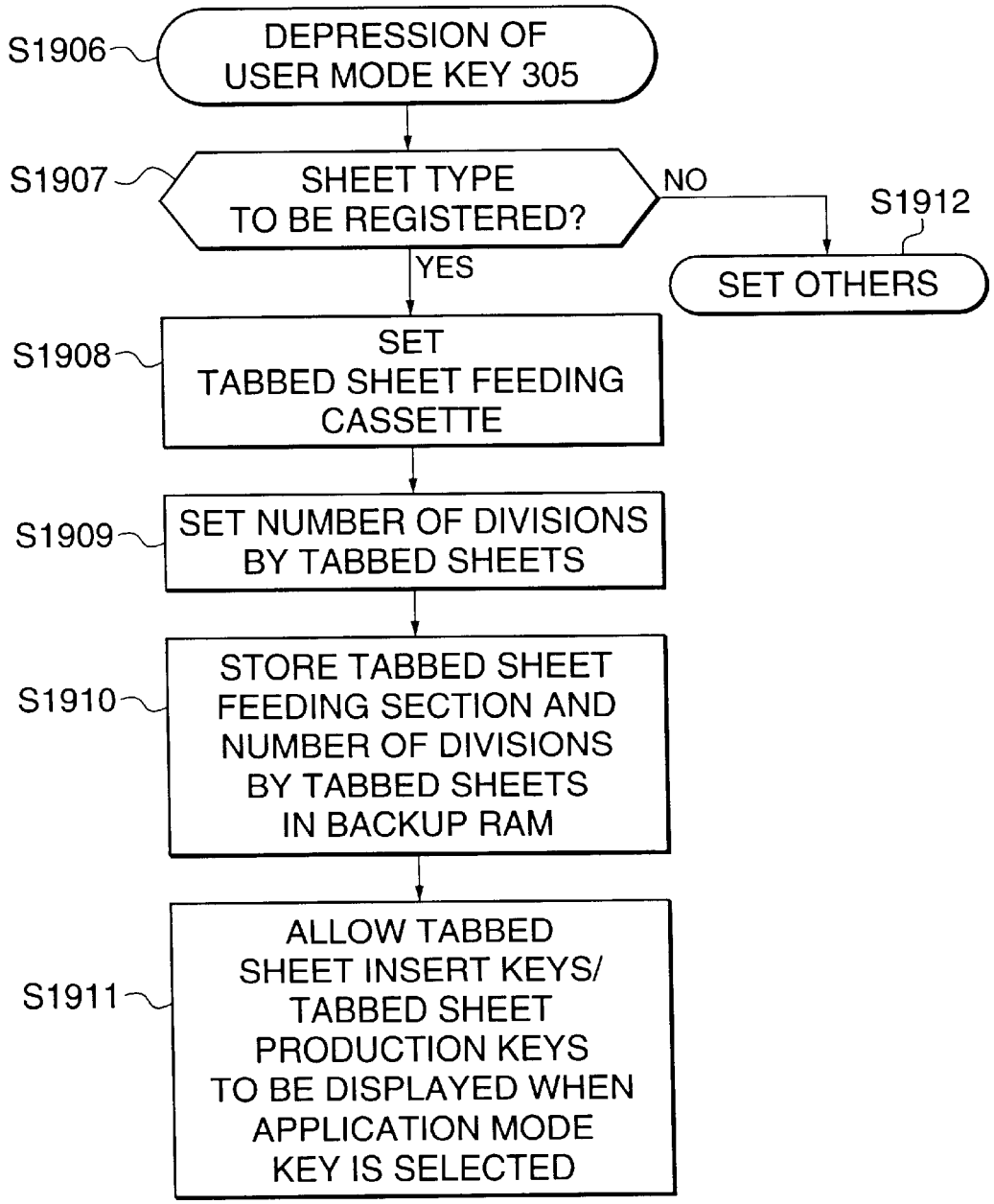
Figure 22:
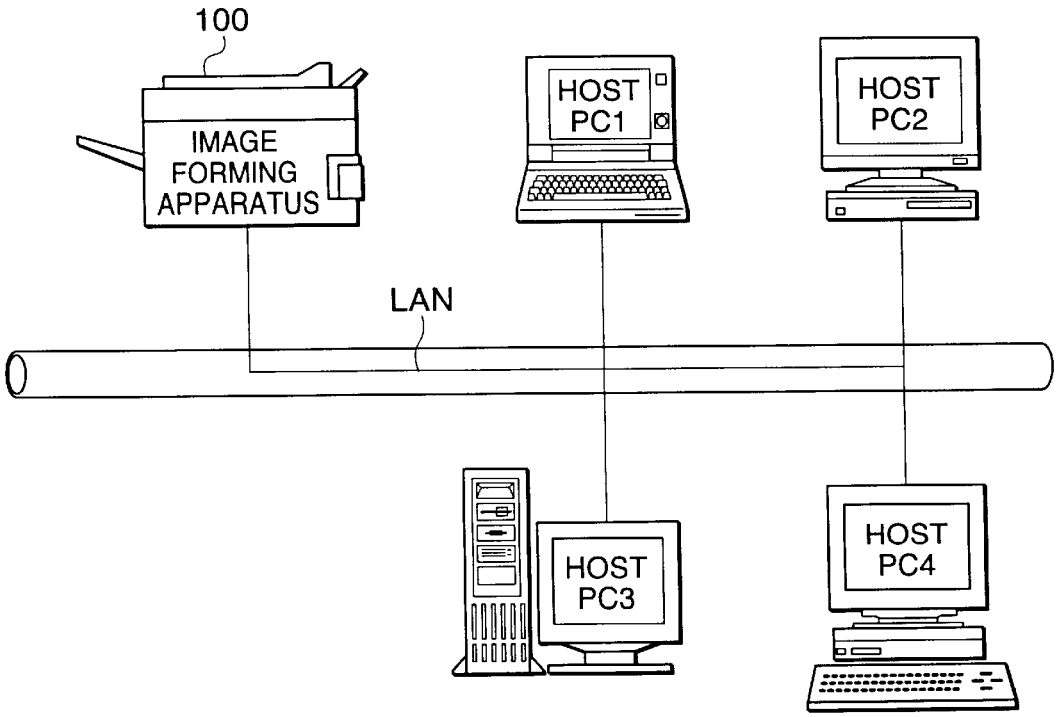
Figure 23A:
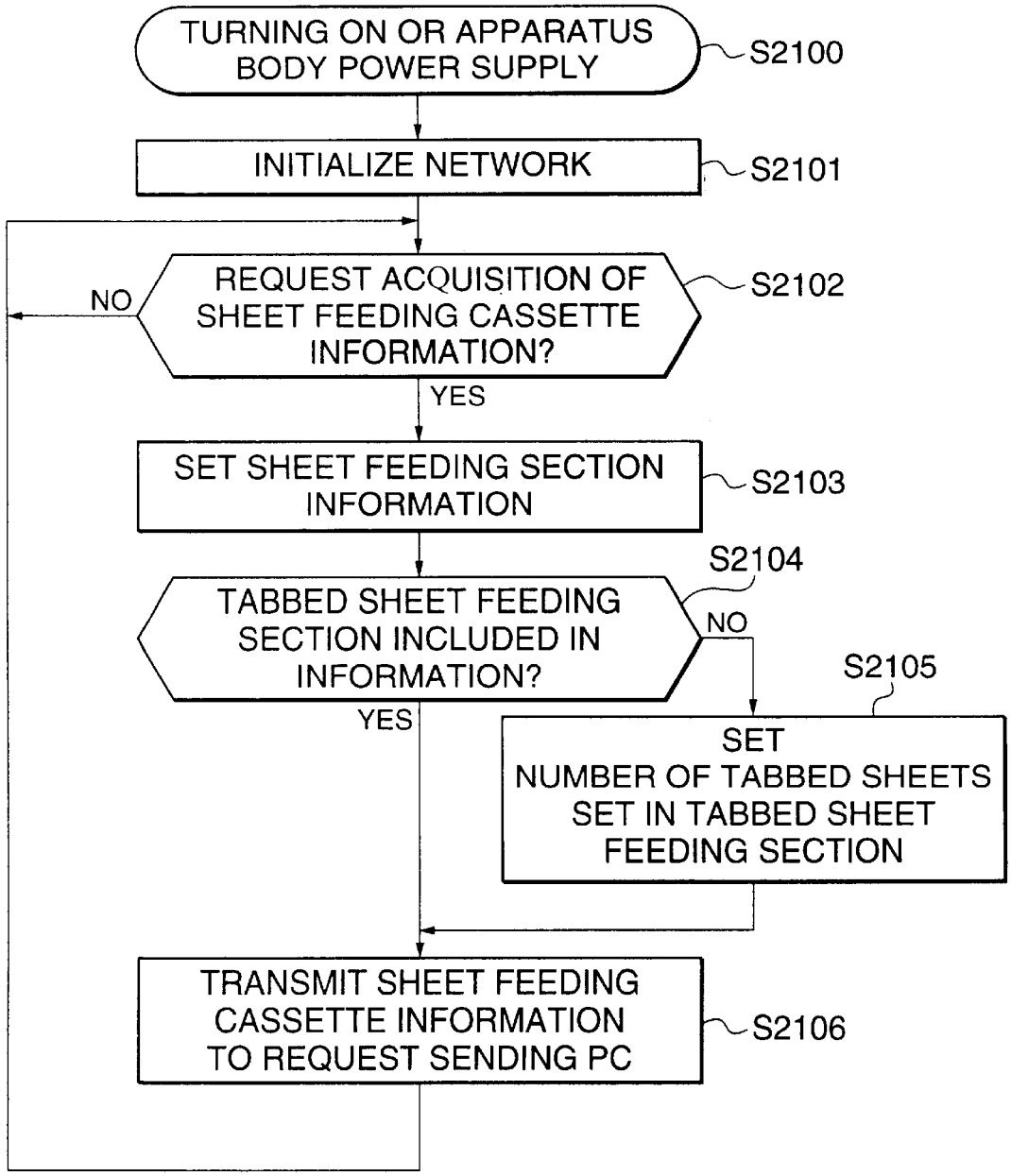
Figure 23B:
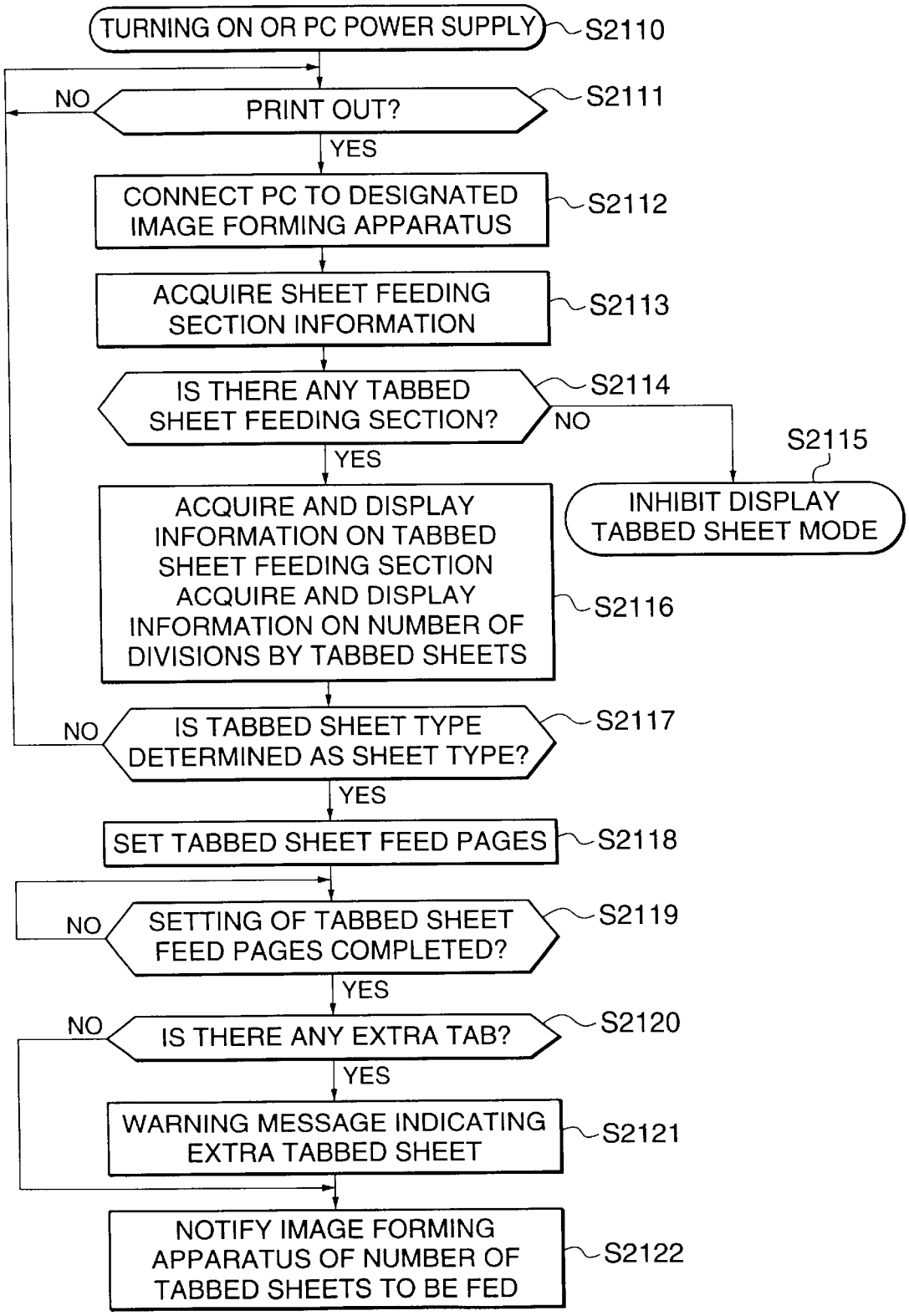
Figure 24:
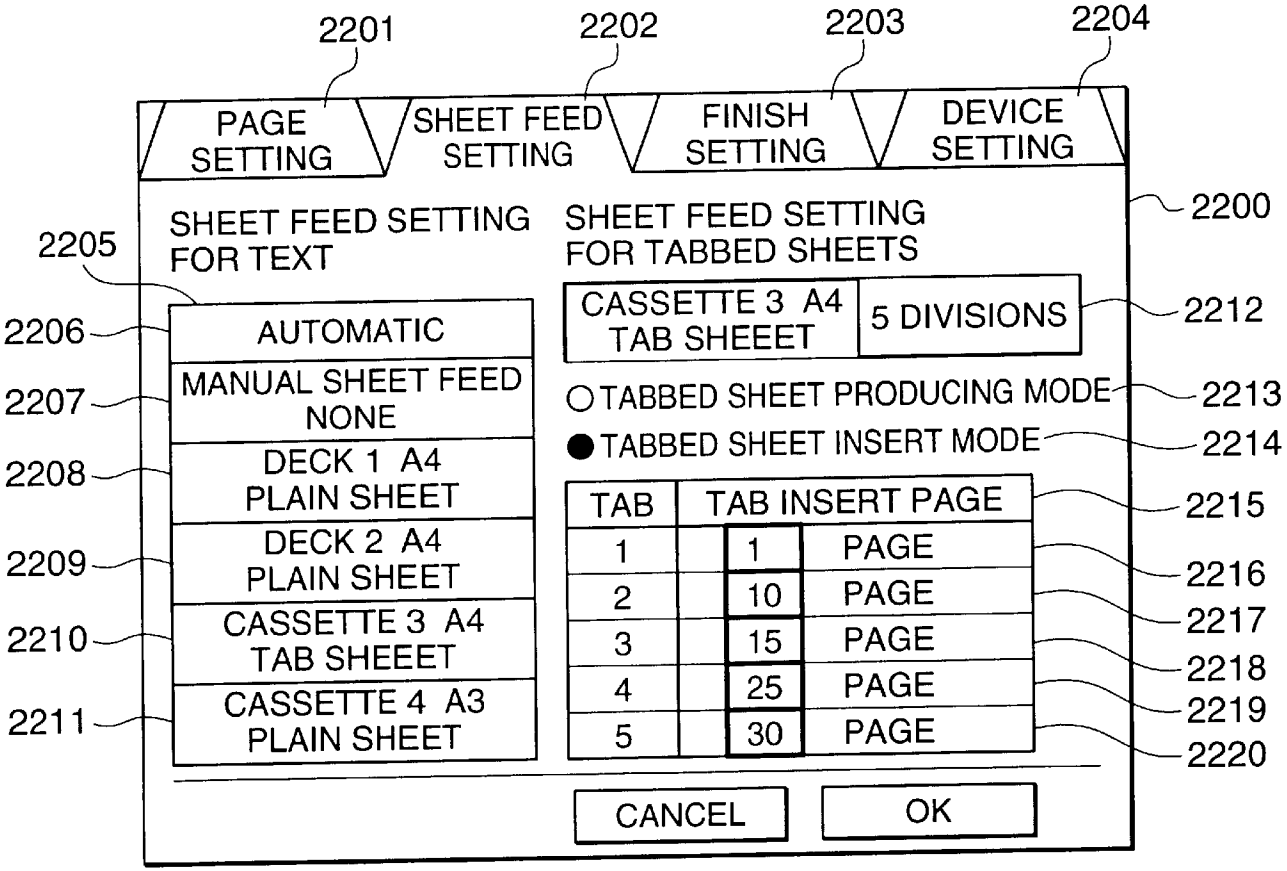
Figure 25:
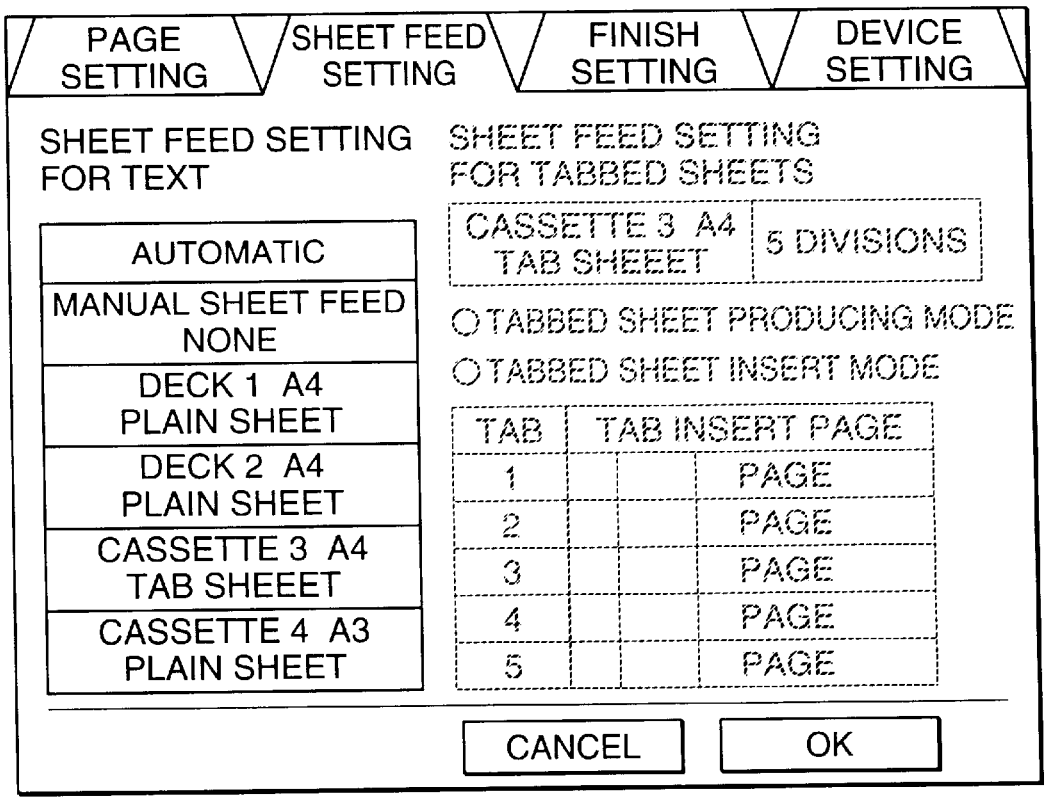
Figure 26:
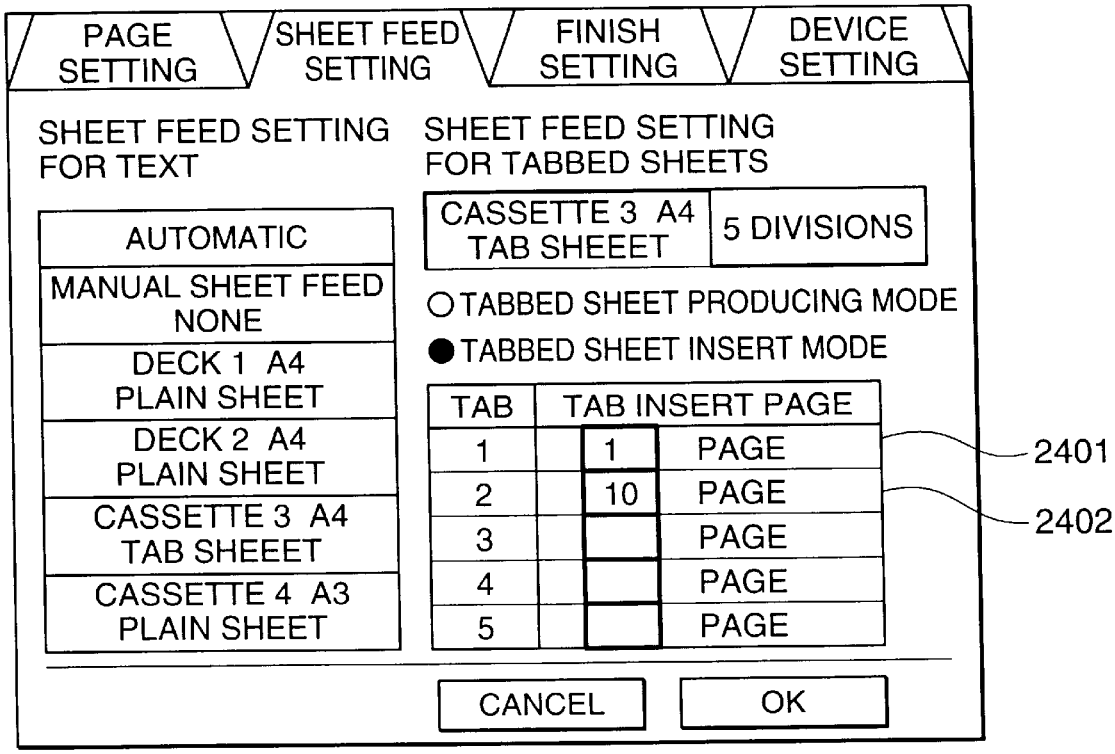
Figure 27:
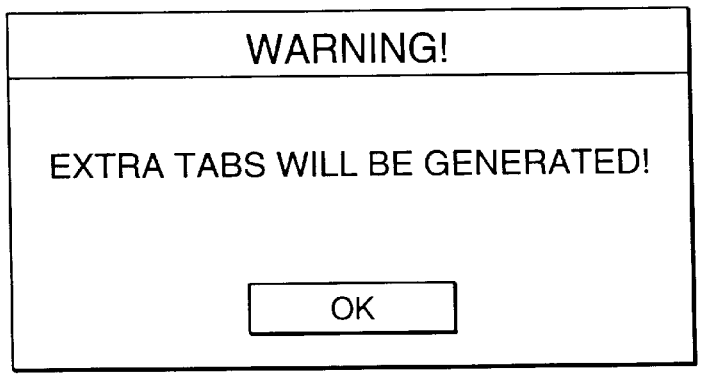
Figure 28A:
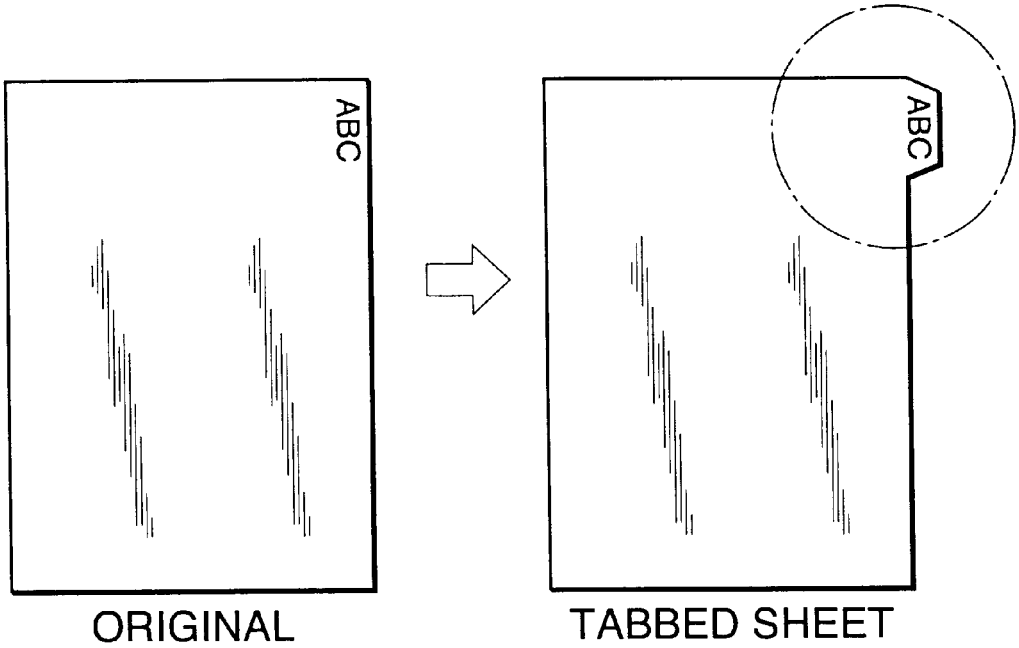
Figure 28B:
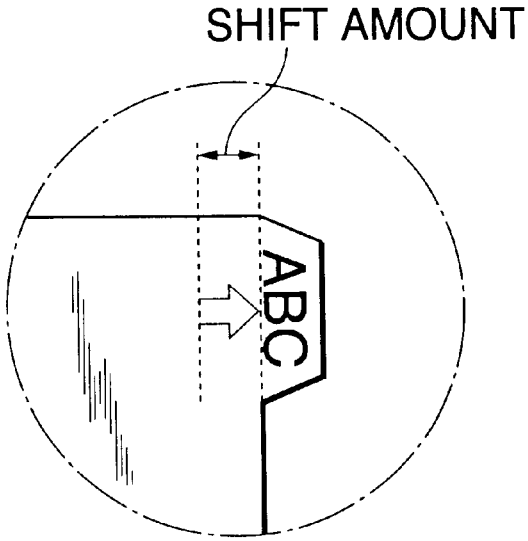

an example of arrangement of is a diagram showing originals in a tabbed sheet producing mode;

FIG. 17 is a diagram showing an example of arrangement of output sheets in the tabbed sheet producing mode;

FIG. 18 is a diagram showing changes in the screen in the tabbed sheet insert mode;

FIG. 19 is a diagram showing changes in the screen screen in the tabbed sheet producing mode;

FIG. 20 is a schematic block diagram showing the circuit arrangement of a function control section;

FIG. 21A is a flow chart showing the procedure for displaying keys in a tabbed sheet print mode;

FIG. 21B is a flow chart showing the procedure for storing and displaying setting information;

FIG. 22 is a diagram showing an example of the state in which the image formatting apparatus is connected to a network;

FIGS. 23A and 23B are flow charts showing a method of acquiring information on a tabbed sheet feeding section;

FIG. 24 is a diagram showing a screen of a printer driver in the case where there is provided a tabbed sheet feeding section;

FIG. 25 is a diagram showing a screen of a printer driver in the case where there is provided no tabbed sheet feeding section;

FIG. 26 is a diagram showing a screen of a printer driver during the setting of the tabbed sheet insert mode;

FIG. 27 is a diagram showing a warning screen in the case where there are extra tabs;

FIG. 28 is a diagram showing a shift amount; and

Figure 29:
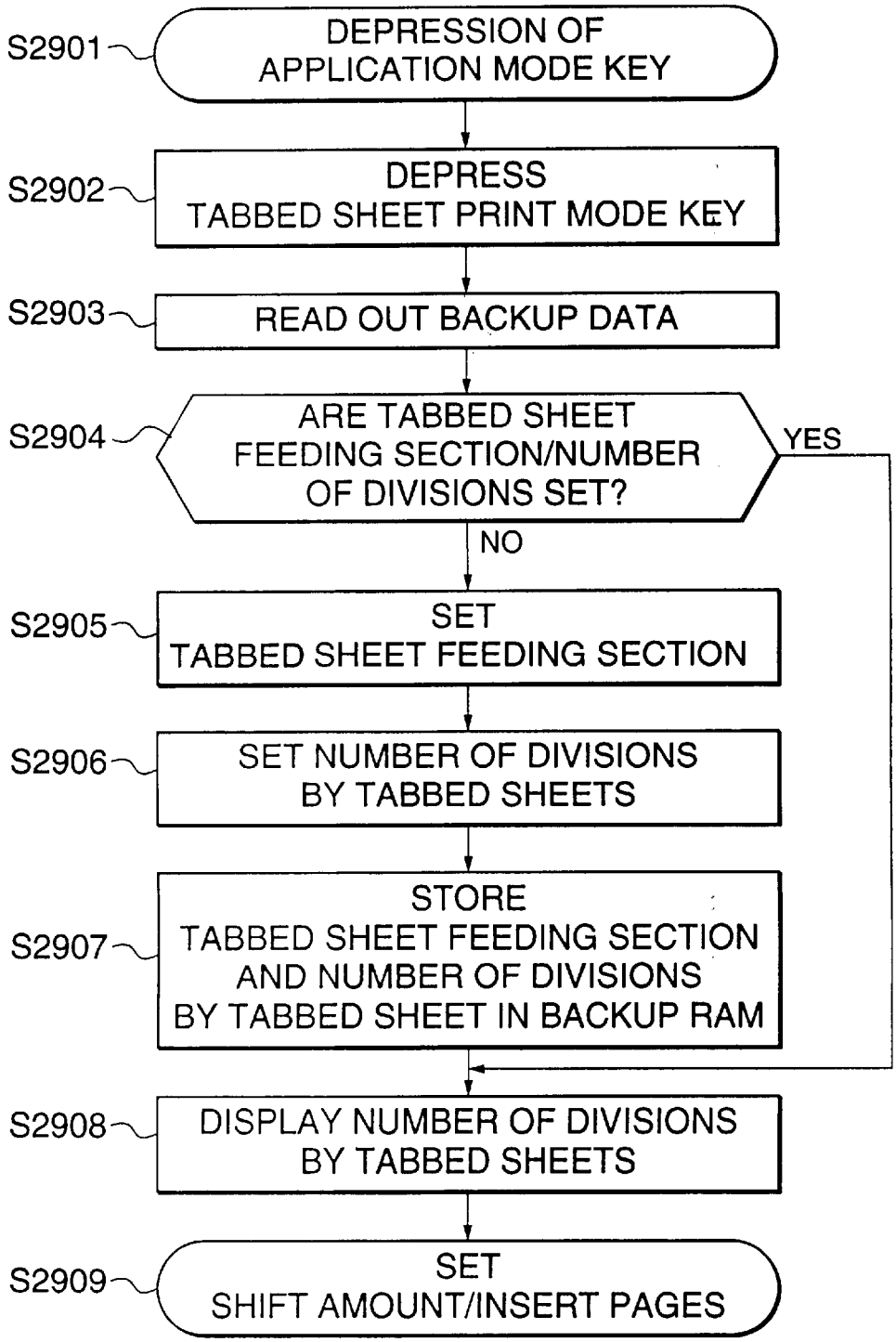

FIG. 29 is a flow chart showing the procedure for enabling the tabbed sheet print mode such as the tabbed sheet insert mode and the tabbed sheet producing mode to be set and displayed according to another embodiment of the present invention.

DETAILED DESCRIPTION OF THE PREFERRED EMBODIMENTS

The present invention will now be described in detail with reference to the drawings showing embodiments thereof.

Figure 1:
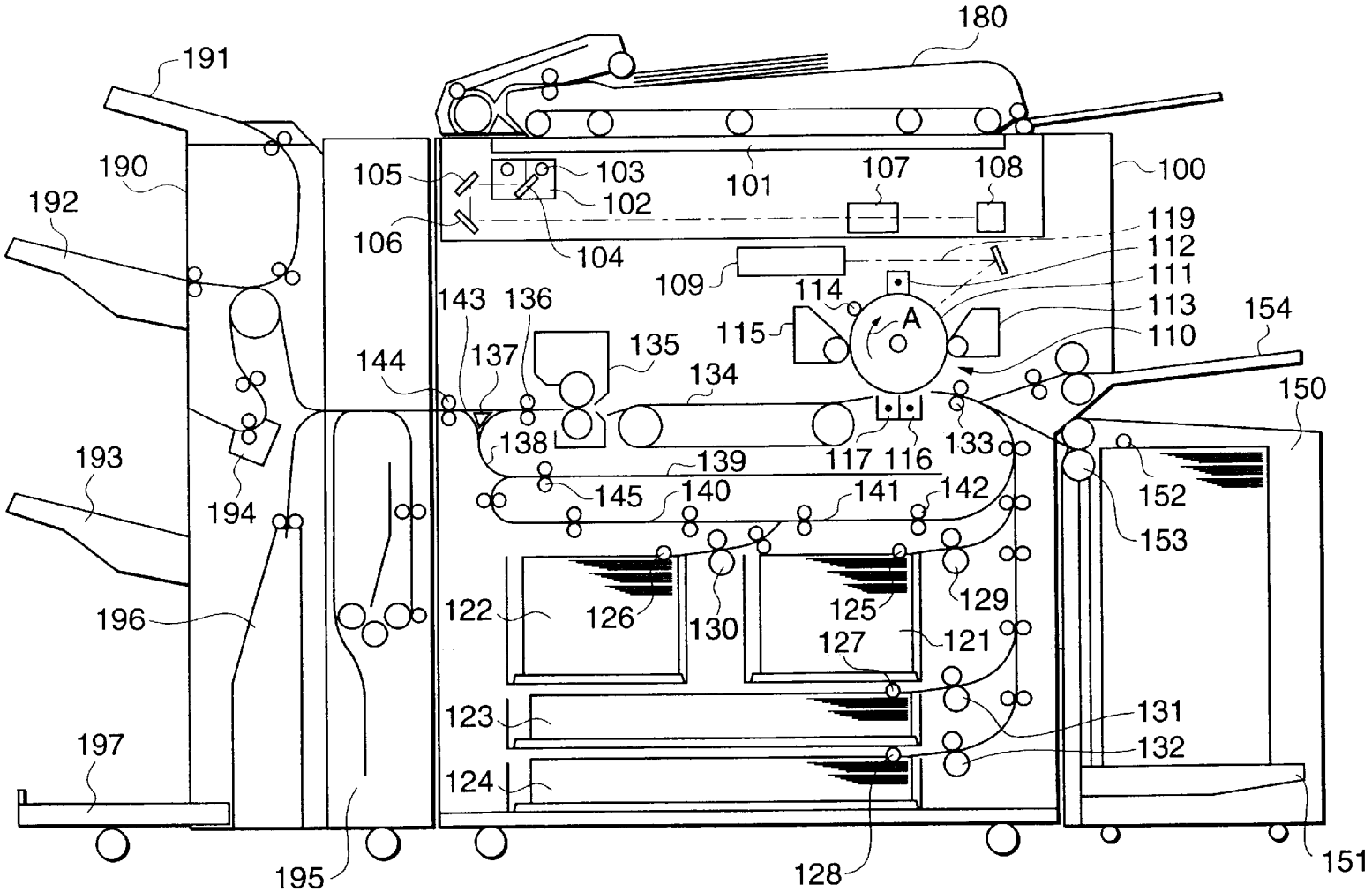
FIG. 1 is a schematic diagram showing the construction of an image forming apparatus according to an embodiment of the present invention.

FIG. 1 is a schematic diagram showing the construction of an image forming apparatus according to an embodiment of the present invention. In FIG. 1, reference numeral 100 denotes an image forming apparatus body; 180, an automatic original feeder (DF); and 101, a platen glass serving as a stand for mounting an original thereon. Reference numeral 102 denotes a scanner that is comprised of an original irradiation lamp 103, and scanning mirrors 104 to 106, and the like. A motor, not shown, drives the scanner 102 to scan the original forward and backward in a predetermined direction. During the forward and backward scanning, reflected light from the original is transmitted through a lens 107 via the scanning mirrors 104 to 106, and an image on the original is formed on a CCD sensor in an image sensor section 108.

Reference numeral 109 denotes an exposure control section comprised of a laser, polygon scanner, and the like. The exposure control section 109 irradiates a photosensitive drum 111 of an image forming section 110 with a laser light 119, which is modulated according to an image signal which is converted into an electric signal by the image sensor section 108 and subjected to predetermined image processing, described later. A primary electrifier 112, a developing device 113, a transfer electrifier 116, a pre-exposure lamp 114, and a cleaning device 115 are arranged around the photosensitive drum 111. A motor, not shown, rotates the photosensitive drum 111 in a direction indicated by an arrow A. The primary electrifier 112 electrifies the photosensitive drum 111 so that it has a desired potential, and the laser light 119 from the exposure control section 109 is then radiated upon the photosensitive drum 111. This forms an electrostatic latent image on the photosensitive drum 111. A toner image is formed by attaching toner from the developer 113 to the electrostatic latent image.

On the other hand, a recording sheet is fed from a first sheet feeding cassette deck 121, a second sheet feeding cassette deck 122, an upper sheet feeding cassette 123, or a lower sheet feeding cassette 124 by pickup rollers 125, 126, 127, 128 and is conveyed toward the image forming section 110 by sheet feeding rollers 129, 130, 131, 132. In the present embodiment, the first sheet feeding cassette deck 121, the second sheet feeding cassette deck 122, the upper sheet feeding cassette 123, and the lower sheet-feeding cassette 124 will also be referred to as the sheet feeding section in the following description.

A recording sheet is conveyed to a position in proximity to the image forming section 110 and then fed to a transfer belt 134 by a resist roller 133. When the recording sheet is brought into contact with the photosensitive drum 111 of the image forming section 110, the transfer electrifier 116 transfers a toner image onto the recording sheet. The cleaning device 115 removes the toner remaining on the photosensitive drum 111 after the transfer. The pre-exposure lamp 114 then erases residual electric charge on the photosensitive drum 111.

After the transfer, the recording sheet is separated from the photosensitive drum 111 by a separation electrifier 117, and is conveyed to a fixing device 135 by the transfer belt 134. The toner image transferred onto the recording sheet is fixed by pressurizing and heating with the fixing device 135. The recording sheet is then discharged to the outside of the image forming apparatus body 100 by a discharge roller 136.

The image forming apparatus body 100 is equipped with a deck 150 that is capable of storing four thousand recording sheets, for example. A lifter 151 of the deck 150 moves upward according to the volume of recording sheets such that the uppermost recording sheet is kept in contact with a pickup roller 152. The uppermost recording sheet is transferred to the image forming apparatus body 100 via a sheet feeding roller 153. The image forming apparatus body 100 is also equipped with a multi manual sheet feeding tray 154 that can accommodate 1000 recording sheets.

Further, in FIG. 1, reference numeral 137 denotes a sheet discharge flapper that switches the path of a recording sheet between a conveying path 138 and a discharge path 143. In duplex recording (duplex copying) in which images are formed on both sides of a recording sheet, the sheet discharge flapper 137 is lifted to cause the recording sheet, which is fed from the sheet discharge roller 136, to once enter an inversion path 139 from the conveying path 138 and then reverse its conveying direction to enter a lower conveying path 140. Consequently, the recording sheet is turned upset down and guided to a sheet refeeding path 141.

A recording sheet fed from the second sheet feeding cassette deck 122 via the sheet feeding roller 130 is also guided to the sheet refeeding path 141. Reference numeral 142 denotes a sheet refeeding roller for refeeding the recording sheet to the image forming section 110.

Reference numeral 144 denotes a discharge roller that discharges the recording sheet, whose path has been switched to the discharge path 143 by the sheet discharge flapper 137, to the outside of the image forming apparatus body 100. When inverting and discharging a recording sheet from the image forming apparatus body 100, the sheet discharge flapper 137 is lifted and an inversion roller 145 is caused to pull the recording sheet into the inversion path 139 to such a position that the rear end of the recording sheet still remains in the conveying path 138. The inversion roller 145 is then reversed in rotation to feed the recording sheet in a reversed state toward the discharge roller 144.

Reference numeral 190 denotes a discharged sheet processing device that aligns and staples recording sheets discharged from the image forming apparatus body 100. The discharged sheet processing device 190 stacks and aligns recording sheets discharged on a sheet-by-sheet basis, on a processing tray 194. If one set of recording sheets with images formed thereon has been discharged, the recording sheets may be stapled and discharged in the form of a bundle onto a sheet discharge tray 192 or 193. The sheet discharge tray 193 is moved up and down by a motor, not shown, and moved to be positioned at the processing tray 194 prior to the start of image formation. Reference numeral 191 denotes a recording sheet tray on which dividing sheets to be inserted between discharged recording sheets are stacked, and reference numeral 195 denotes a Z folding machine that folds discharged recording sheets in the form of Z. Reference numeral 196 denotes a binder that binds one set of discharged recording sheets by folding at the center and stapling, and a bundle of the thus bound recording sheets is discharged onto a discharge tray 197.

Figure 2:
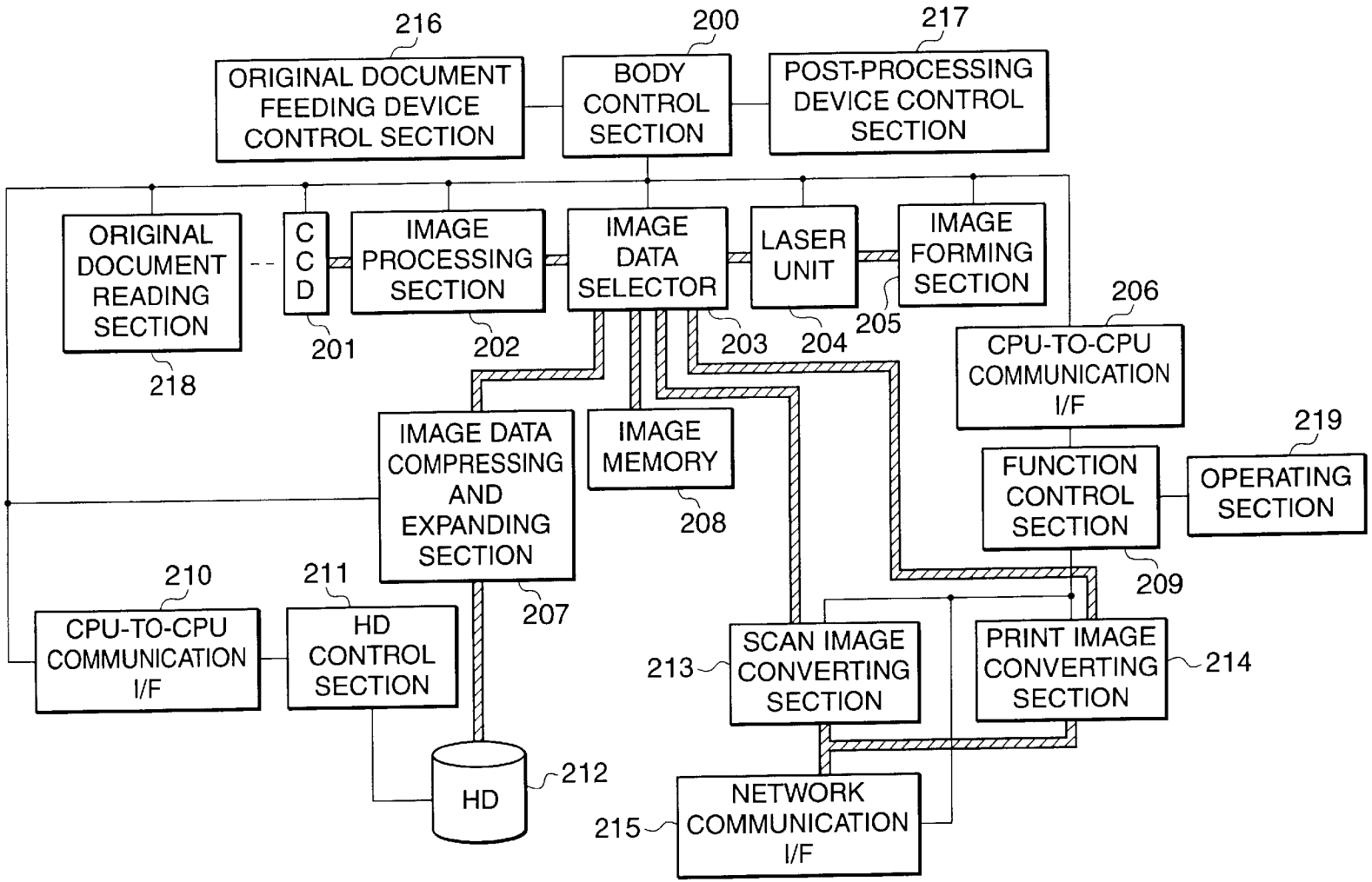
FIG. 2 is a block diagram showing the arrangement of a control circuit in the image forming apparatus in FIG. 1.

FIG. 2 is a block diagram showing the arrangement of a control circuit in the image forming apparatus of FIG. 1.

In FIG. 2, reference numeral 200 denotes a body control section that controls the image forming apparatus body in order to drive an image reading section, an image forming section 205, and the like. The control section 200 includes a CPU, a RAM that provides a work area for the CPU, and a ROM that stores a control program for controlling the image forming apparatus as a whole as well as programs for executing operation modes, described later.

For example, the body control section 200 provides control such that an image processing section 202 converts image data read by a CCD 201 into desired image data, and that an image data selector 203 selects the destination of the read image data from among a laser unit 204, an image data compressing section 207, an image memory 208, and a function control section 209. The body control section 200 controls the image forming apparatus and the image data so as to instruct an original feeding device control section 216 to feed an original and give a post-processing device control section 217 a command indicating what type of mode is to be set. Further, the body control section 200 executes a tabbed sheet insert mode and a tabbed sheet producing mode, described later (these modes will be generically referred to as the tabbed sheet print mode_).

The CCD 201 captures and photoelectrically converts reflected light from an original image acquired by irradiating an original from an original reading section 218 comprised of an original stand, an original irradiating section, an optical system, and the like, and then outputs the resulting image data. The image processing section 202 carries out an image processing operation on the image data outputted from the CCD 201 according to an image processing function set by an operating section 219. The laser unit 204, the image data compressing and expanding section 207, the image memory 208, the function control section 209 and an image data bus, described later, are connected to the image data selector 203, which selects the flow direction of image data according to control information obtained from the body control section 200.

The laser unit 204 exposes image data developed on a recording sheet by the image forming section 205, to laser. As mentioned above, the image forming section 205 actually develops the image data exposed to laser on a recording sheet.

Reference numeral 206 denotes a CPU-to-CPU communication interface I/F for communicating control information between the body control section 200 and the function control section 209, described later. The image data compressing and expanding section 207 compresses image data outputted from the image data selector 203 to reduce the share of image data on a hard disk (HD) as a mass storage nonvolatile memory when storing the image data on the HD, and expands the compressed image data on the HD into the original image data when transferring the compressed image data to the image data selector 203. The image memory 208 is comprised of a nonvolatile memory for temporarily storing image data transmitted from the image data selector 203 and transferring the temporarily stored image data to the image data selector 203.

The function control section 209 communicates with the body control section 200 and transmits image data transmitted from the image data selector 203 to a scan image converting section 213, described later. The function control section 209 communicates image data control information for transmitting image data transmitted from the print image converting section 214, which converts print image data transmitted from a network communication I/F 215, described later, to the image data selector 203, and image forming apparatus control information transmitted from the operating section 219 of the body, with the body control section 200 via the CPU-to-CPU communication interface 210.

The CPU-to-CPU communication interface I/F 210 communicates control information for controlling image data stored in a HD 212 between an HD control section 211, described later, and the body control section 200. The HD control section 211 provides control such that image data transmitted from the image data compressing and expanding section 207 is written into the HD 212, and image data stored in the HD 212 is read and transmitted to the image data compressing and expanding section 207, according to the control information transmitted from the body control section 200 via the CPU-to-CPU communication interface I/F 210.

Under the control of the HD control section 211, image data transmitted from the image data compressing and expanding section 207 or image data to be transmitted to the image data compressing and expanding section 207 is written into and read out from the HD 212 that is a nonvolatile memory.

The scan image converting section 213 converts image data transmitted from the image data selector 203 under the control of the body control section 200 so that the image data can be read using application software operating on a host computer connected to a network via the network communication I/F 215. The print image converting section 214 converts image data written in PDL transferred from application software operating on the host computer connected to the network via the network communication I/F 215 into image data that can be printed out by the image forming section 205 of the image forming apparatus.

The communication I/F 215 is used to connect the image forming apparatus to a network, and provides interface when communicating image data and control information between the image forming apparatus and the network (e.g. computers) according to a specific communication protocol.

The original feeding device control section 216 controls the original feeding device 101 that feeds a plurality of originals to the original stand, as described in detail with reference to FIG. 3, and feeds the originals according to control information transmitted from the body control section 200. The post-processing device 217 performs post-processing of outputted recording sheets with images formed thereon (hereinafter referred to as the output sheets) according to control information transmitted from the body control section 200. The original reading section 218 irradiates the original according to control information transmitted from the body control section 200 and projects reflected light from an image on the original upon the CCD 201 by driving the optical system.

The operating section 219 is used to operate the image forming apparatus according to the present embodiment. Information on keys inputted via the operating section 219 is transferred to the function control section 209, which then analyzes commands of the keys and transmits control information for operating the apparatus to the control section 200 via the CPU-to-CPU I/F 206.

A description will now be given of a basic operation carried out by the control circuit of FIG. 2 constructed above, by referring to an example in which an image is copied at a reduction rate of 50%.

First, when a key indicating the 50% reduction is depressed in the operating section 219, the function control section 209 is notified of the depression. The function control section 209 recognizes the depression of the key indicating the 50% reduction by analyzing a command of the key, and then stores information on the depression. When a copy start button is depressed in the operating section 219, the function control section 209 is notified of the depression. The function control section 209 recognizes the depression of the copy start button by analyzing command of the key and notifies the body control section 200 of an instruction for starting copy having been given as well as copying information such as a copy mode, the reduction rate of 50%, the number of copies to be made (1 in this example) via the CPU-to-CPU communication I/F 206.

In response to the notification from the function control section 209, the body control section 200 monitors the status of the HD control section 211 through the original feeding device control section 216, post-processing device control section 217 and CPU-to-CPU communication I/F 210, and instructs the image processing section 202 to set the 50% reduction when it determines that it is possible to start copying. In response to the notification of the copy mode, the body control section 200 causes the image data selector 203 to set an image path so that image data can flow to the image data compressing and expanding section 207, the image memory 208, and the laser unit 204. In response to the instruction for starting the copy, the body control section 200 checks the status of the original feeding device 101 through the original feeding device control section 216. If there is any original, the body control section 200 instructs the original feeding device control section 216 to feed the original, and instructs the original reading section 218 to move to such a position as to read the original fed from the original feeding device 101. At the same time, the body control section 200 checks the status of the post-processing device through the post-processing device control section 217, and instructs the post-processing device control section 217 to provide control such that the post-processing device can receive a recording sheet printed and outputted by the image forming section 205.

Further, an image obtained by reading the original is written into the HD 212 via the image data selector 203 and the image data compressing and expanding section 207. Thus, if an image is to be written into the HD 212, or if there is a plurality of originals or a plurality of copies is to be made, the HD control section 211 is instructed to read out the image from the HD 212 via the CPU-to-CPU communication I/F 210.

Further, the body control section 200 initializes the CCD 201, the laser unit 204, and the image forming section 205 to enable the copying operation. The body control section 200 then checks through original feeding device control section 216 that the original feeding device 101 has fed the original to an original reading position, checks through the post-processing device control section 217 that the post-processing device is ready to receive the recording sheet printed and outputted from the image forming section 205, and checks that the original reading section 218 has reached such a position as to read the original placed on the original stand, and that a recording sheet to be printed and outputted in the image forming section 295 is ready to be printed. To start reading and printing out the image, the body controls section 200 then instructs the image processing section 202, the image data selector 203, the image memory 208, the image data compressing and expanding section 207, and the HD control section 211 to start capturing image data, which is obtained by photoelectrically converting reflected light from the image on the original by the CCD 201.

Assuming that the number of copies to be made is 1 as in this example, the body control section 200 meters a period of time over which the image data is written into the image memory 208 to such an extent that it can be printed out. If the period of time has elapsed, the body control section 200 instructs the image data selector 203, the laser unit 204, and the image forming section 205 to start printing out the image data.

Figure 3:
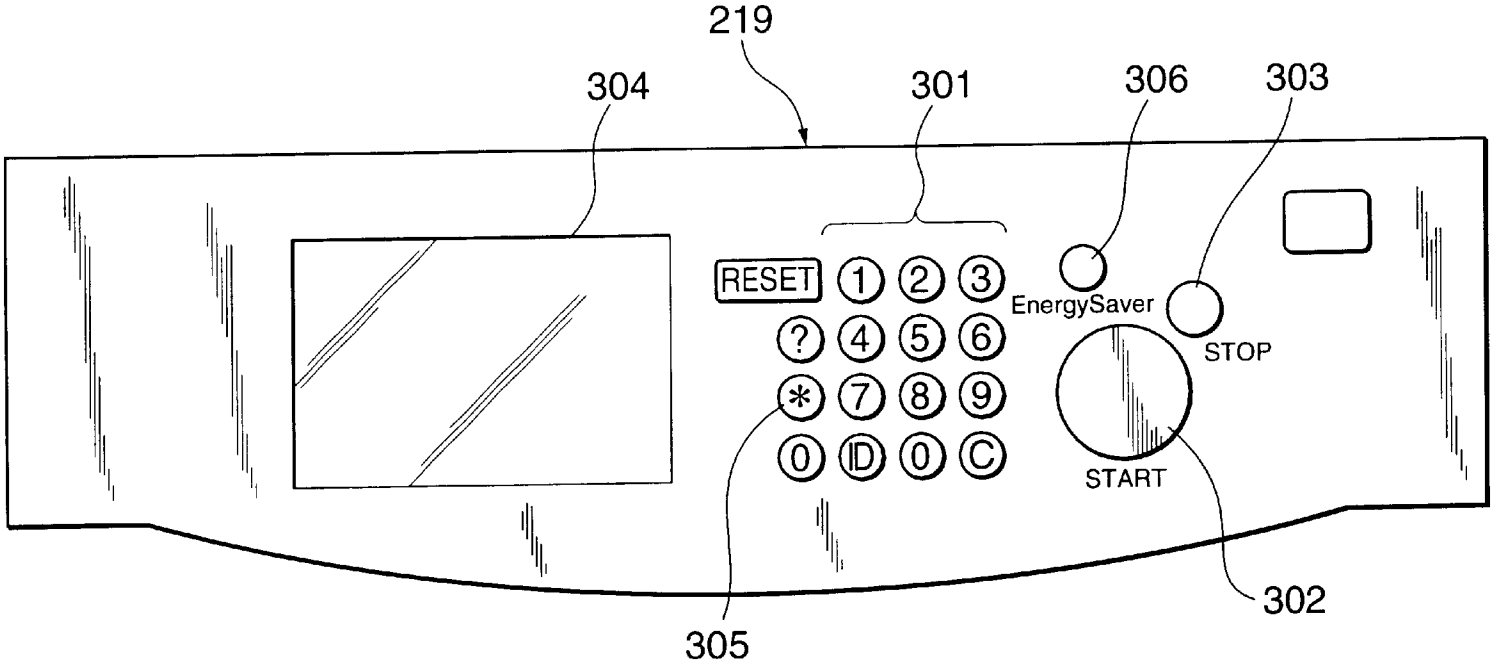
FIG. 3 is a diagram showing the details of an operating section 219 appearing in FIG. 2.

FIG. 3 is a diagram showing the details of the operating section 219 in FIG. 2. In FIG. 3, reference numeral 301 denotes ten keys that are operated to input the number of copies to be made, the shift amount of an image, and the like. Reference numeral 302 denotes a start key that is operated to start a copy job and the like. Reference numeral 303 denotes a stop key that is operated to stop an already started job.

Reference numeral 304 denotes an LCD display and input section that is generally used to set a mode for a copy job and display the operating state of the copying machine. The LCD display and input section 304 is comprised of a touch panel display. Reference numeral 305 denotes a user mode key that is used to set respective items of a user mode in which settings of items relating to the operation and display are carried out so that the settings are reflected upon during a normal mode of the copying machine. Reference numeral 306 denotes an energy saving mode key that is used to shift the mode to a power saving mode in which the copying machine body is set on standby to save power consumption after a user finishes a job such as copying.

Figure 4:
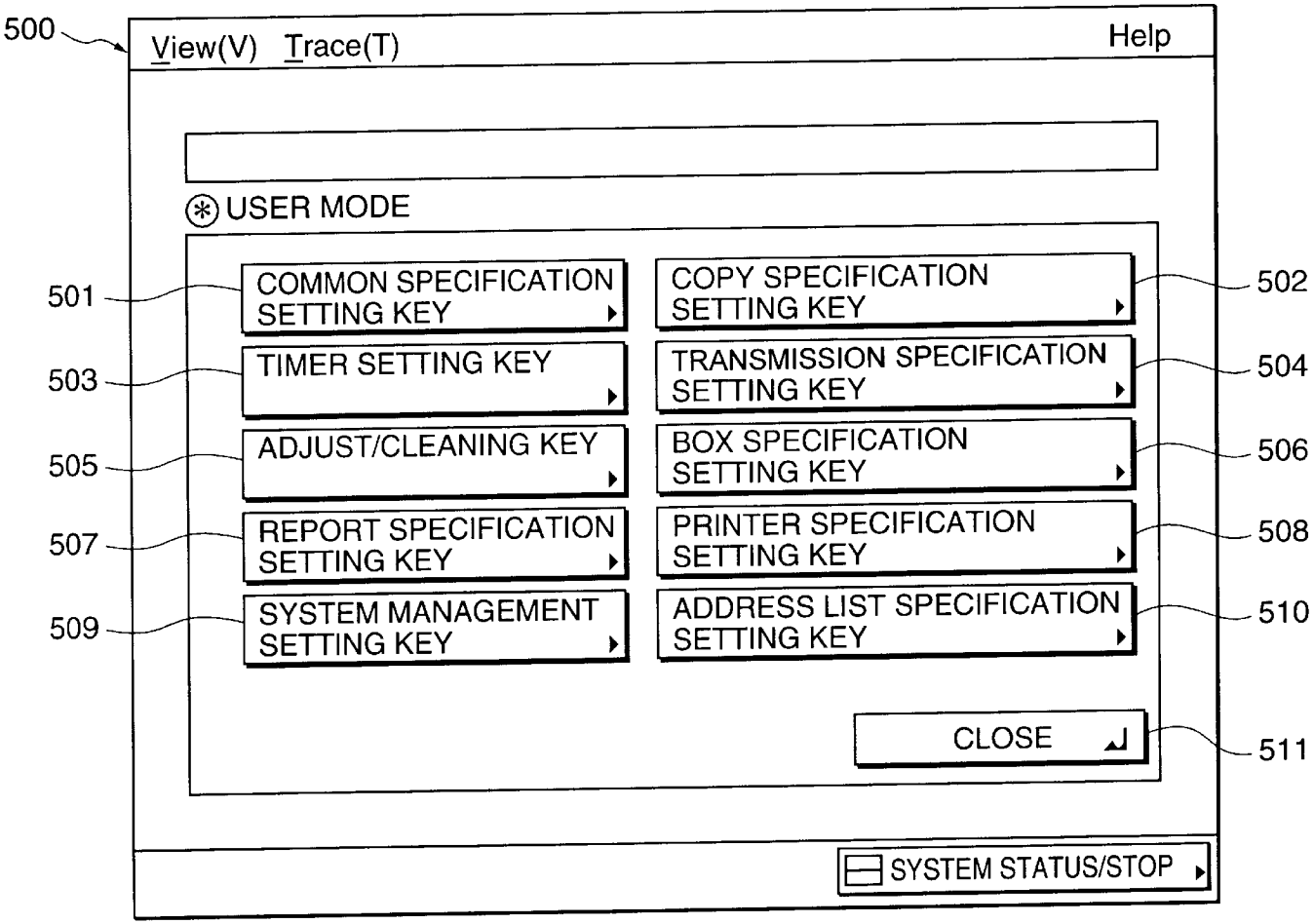
FIG. 4 is a diagram showing a screen that is displayed on an LCD 304 upon depression of a user mode key 305 appearing in FIG. 3.

FIG. 4 through FIG. 8 show screens that are displayed on the LCD display and input section 304 to enable setting a tabbed sheet feeding section in the user mode. The function control section 209 controls the screens displayed on the LCD display and input section 304. FIG. 4 shows a screen that is displayed on the LCD 304 upon depression of the user mode key 305 in FIG. 3. Setting items are listed on a user mode window 500 in FIG. 4. Examples of keys for setting the items in the user mode include a common specification key 501 for setting common user specifications applied to all of the functions such as a copying function and a printer function to be executed by the copying machine; a copy specification setting key 502 for setting user specifications specialized for the copying function; a timer setting key 503 for setting an energy saving time and a copying machine power-off time; a transmission specification setting key 504 for setting user specifications for transmission of a read original image; an adjust/cleaning key 505 for adjusting copying process conditions and reading density of the copying machine and cleaning a roller of the ADF (automatic document feeder); a box specification setting key 506 for setting user specifications relating to a box function of storing a read original and image data transmitted from the print image converting section 214; a report specification setting key 507 for setting specifications of a report on a copy job, print job, scan job, or the like; a printer specification setting key 508 for setting specifications relating to the print image converting section 214, a system management setting key 509 for setting a password owned by a system manager of the copying machine; and an address list specification setting key 510 for registering a list of addresses, etc. for transmitting read images, which is used by the transmission function of transmitting read images.

Reference numeral 511 denotes a key that is used to close the user mode window 500. Upon depression of the key 511, a normal screen, described later, is displayed. The normal screen in FIG. 9 can be displayed by depressing the user mode key 305, too.

Figure 5:
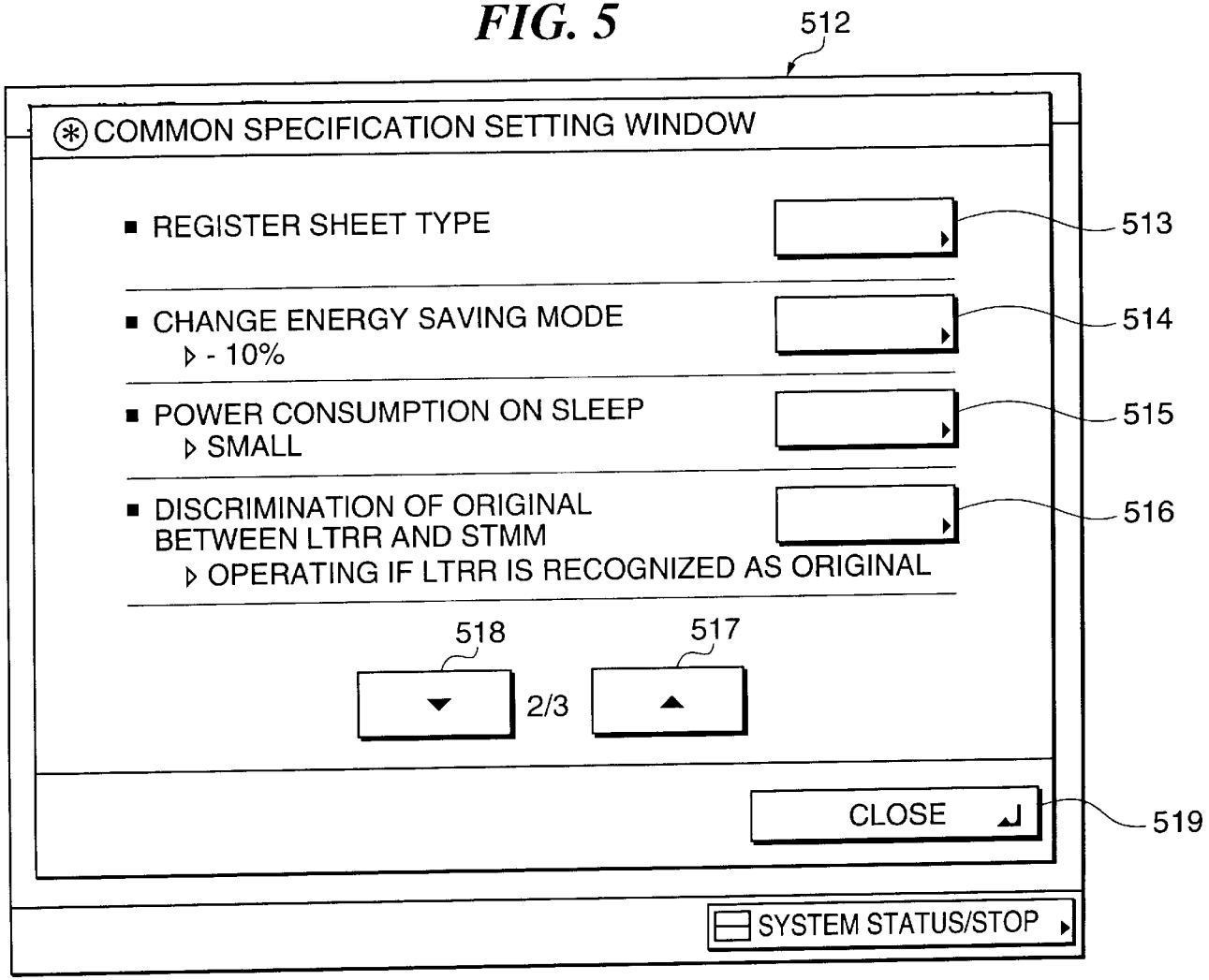
FIG. 5 is a diagram showing a common specification setting window that is displayed upon depression of a common specification setting key 501 in FIG. 4.

FIG. 5 is a diagram showing a common specification setting window that is displayed upon depression of the common specification setting key 501 in FIG. 4. A list of common specification setting items is displayed on the common specification setting window 512. Operating an upward scroll key 517 and a downward scroll key 518 scrolls the window 512 to show other setting items.

An indication "2/3" between the upward scroll key 517 and the downward scroll key 518 means that the scrolled page is the second page among the total three pages. On the common specification setting window 512, a recording sheet type registration key 513 is used to register the type of recording sheets in order to indicate on the LCD display and input section 304 what type of recording sheets are inserted in respective ones of the sheet feeding cassettes 121–124 and 150.

An energy saving mode changing key 514 is used to set an extent to which the electric power consumption is to be controlled in the energy saving mode that is started upon depression of the energy saving mode key 306. In a sleep state, a power consumption key 515 is used to set the degree of the sleep state of the copying machine body, that is, set the level of the power consumption at which the supply of power to respective ones of the control sections such as the body control section 200, original feeding device control section 216, post-processing device control section 217, and HD control section 211 and respective loads such as motors and units connected to the control respective control sections is to be stopped. In this connection, the function control section 209 connected to the operating section 219 is not subjected to the stop of the power supply since it consumes only a small amount of electric power, and is in charge of returning from the sleep state.

Reference numeral 516 denotes an LTRR/STMT original discrimination key that is used to determine whether an LTRR original or an STMT original having the same length in the width direction is regarded as an original. Reference numeral 519 denotes a key that is used to close the common specification setting window 512. Upon depression of the key 519, the screen returns to the user mode window 500.

Figure 6:
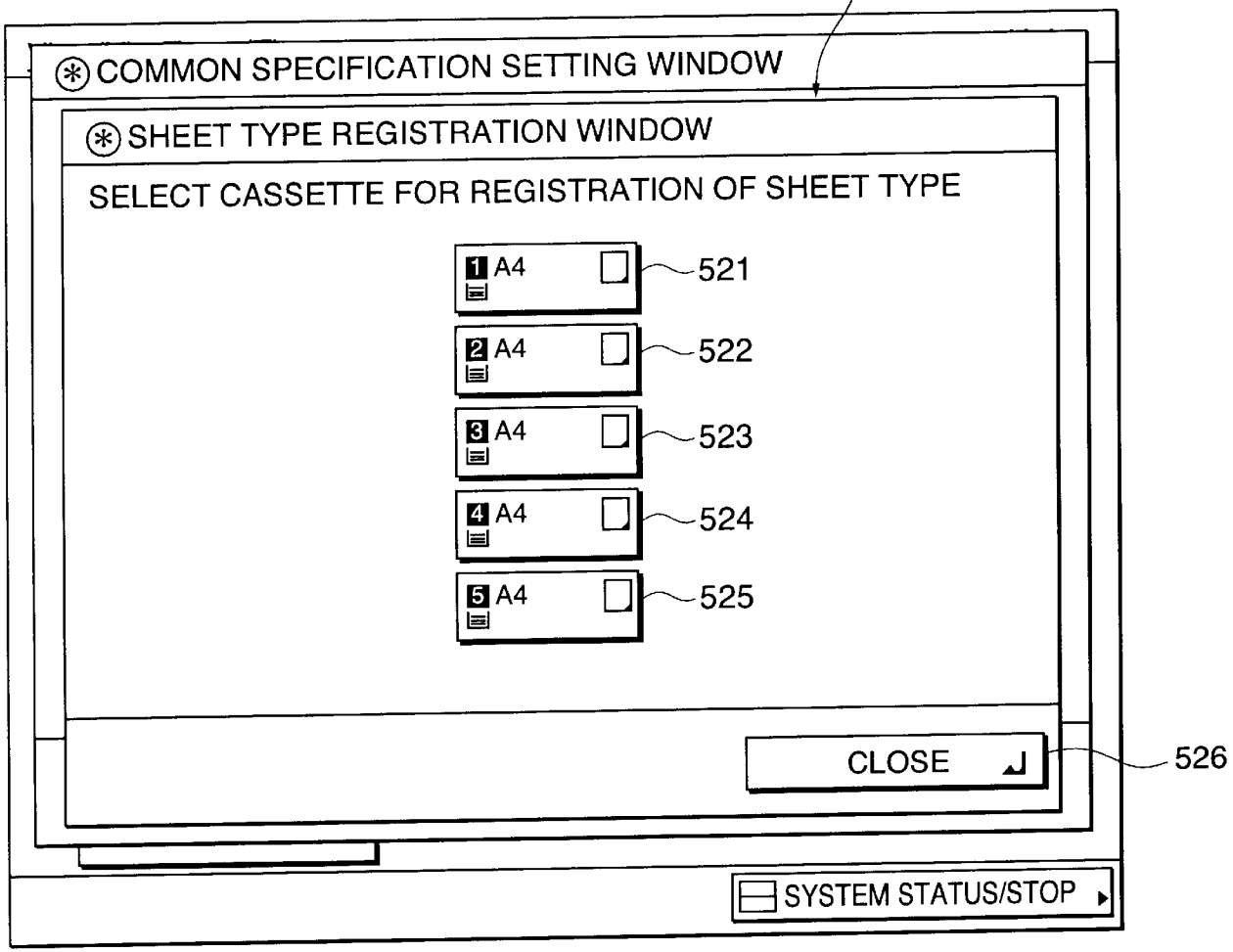
FIG. 6 is a diagram showing a sub window for registering and setting a recording sheet type, which is displayed upon depression of a recording sheet type registration key 513.

FIG. 6 is a diagram showing a sub window 520 that is displayed upon depression of the recording sheet type registration key 513 in order to register the type of recording sheets. Reference numerals 521–525 denote sheet feeding section keys corresponding, respectively, to the sheet feeding sections 121–124 and 150 in FIG. 1. A recording sheet type setting sub window 530 shown in FIG. 7 is opened by depressing any one of the sheet feeding section keys 521–525 which is selected for registration of the desired recording sheet type.

Figure 7:
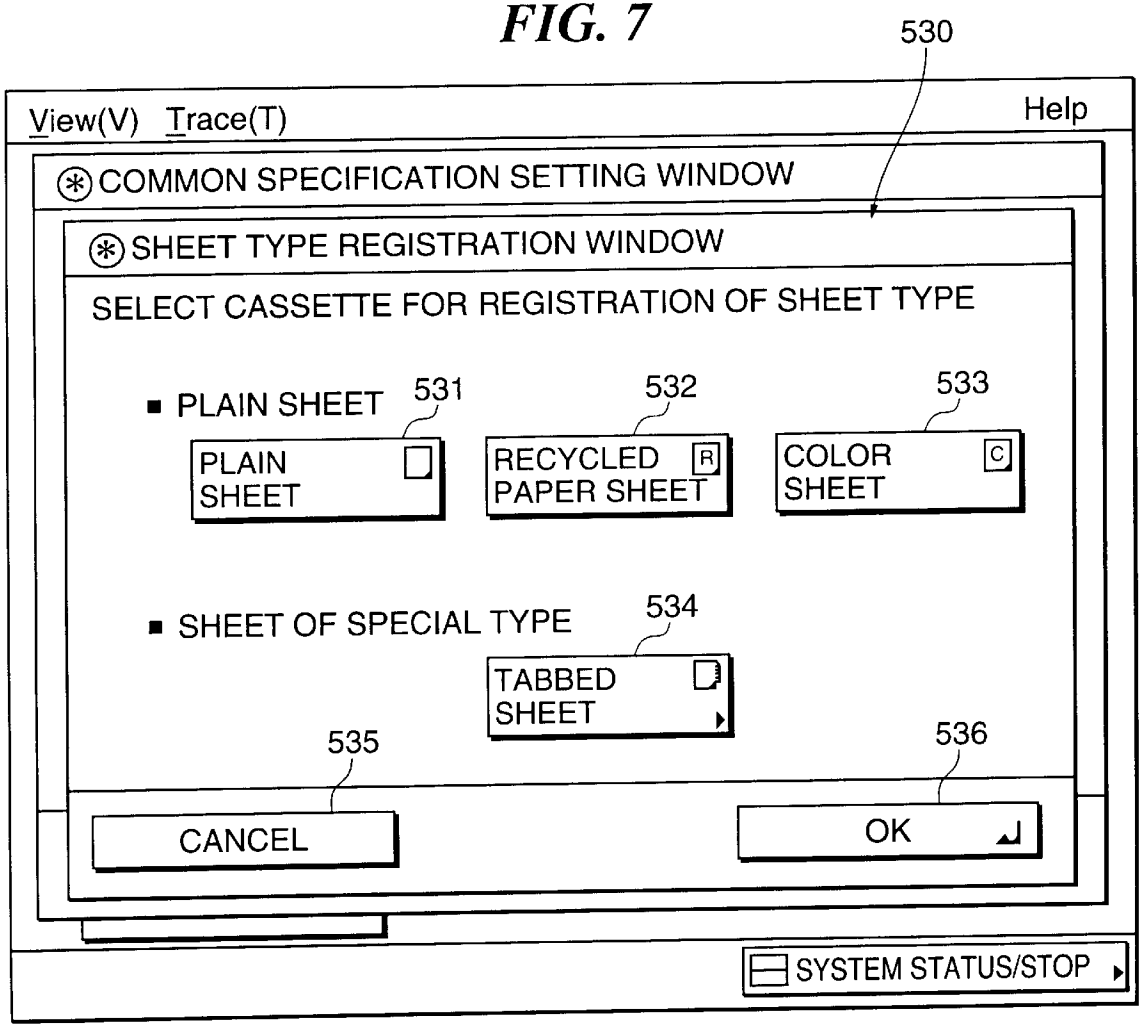
FIG. 7 is a diagram showing a recording sheet type setting sub window that is opened upon depression of a sheet feeding cassette key in FIG. 6.

In FIG. 7, reference numeral 531 denotes a plain sheet registration key that is used to register a plain sheet type such as 64 g/mm as the type of recording sheets stored in the sheet feeding section. Reference numeral 532 denotes a recycled paper sheet registration key that is used to register a recycled paper sheet type as the type of recording sheets stored in the sheet feeding section. Reference numeral 533 denotes a color sheet registration key that is used to register a color sheet type as the type of recording sheets stored in the sheet feeding sections.

Figure 8:
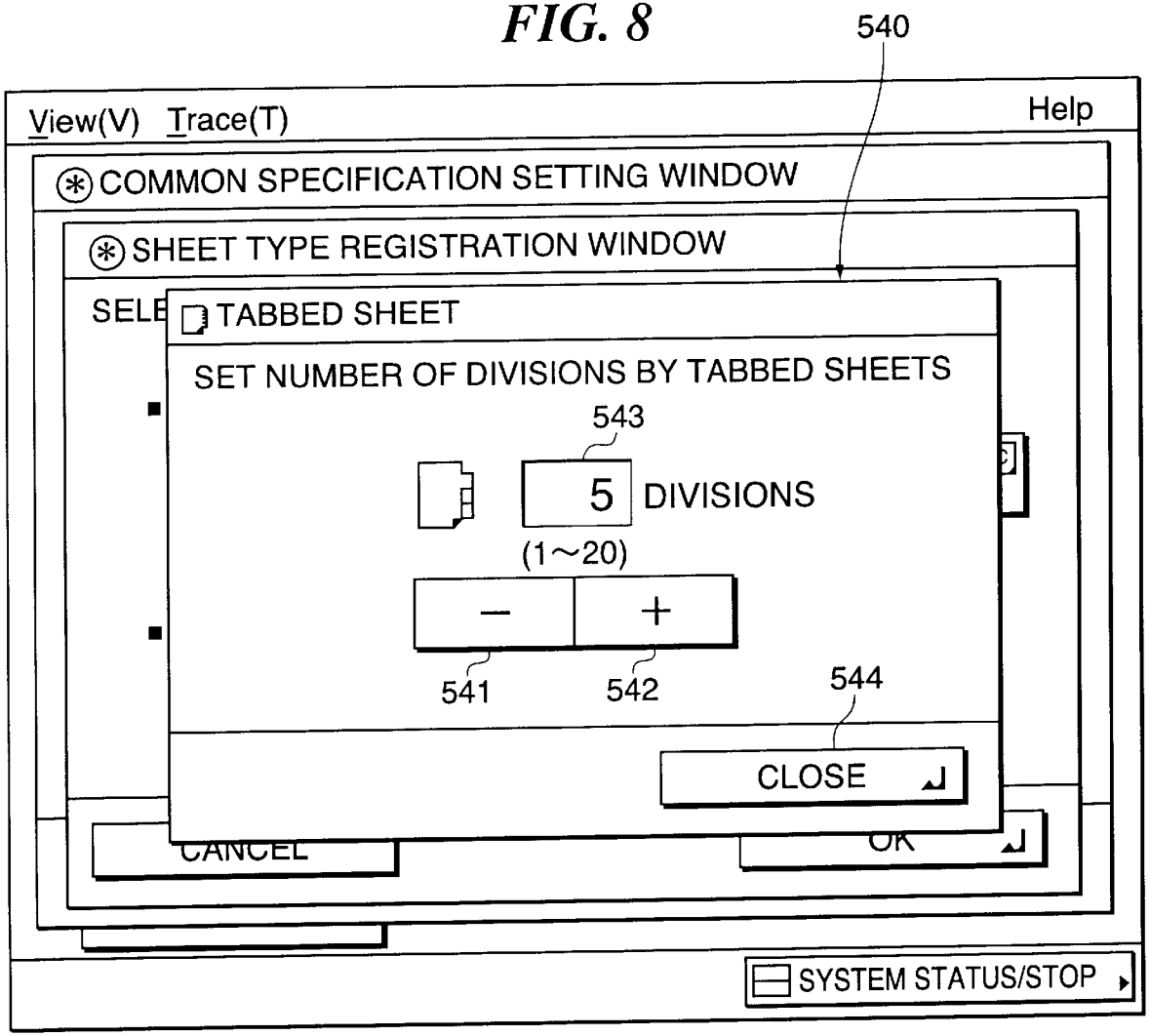
FIG. 8 is a diagram showing a sub window for inputting the number of divisions by tabbed sheets, the sub window being opened upon depression of a tabbed sheet registration key 534 in FIG. 7.

Reference numeral 534 denotes a tabbed sheet registration key that is used to register a tabbed sheet type as the type of recording sheets stored in the sheet feeding section. Upon depression of the tabbed sheet registration key 534, a tabbed sheet division number input sub window 540 is displayed as shown in FIG. 8. According to the present embodiment, the number of divisions means the number of tabbed sheets included in one set that is formed by sequentially stacking commercially sold tabbed sheets having tabs (tab portions) at different positions on a sheet-by-sheet basis. A plurality of sets formed into a bundle are sold on the market. The number of divisions displayed on a division number display window 543 is set by operating a minus key 541 and a plus key 542. Although ordinarily a set of tabbed sheets is comprised of five sheets, the copying machine according to the present embodiment may be configured to handle a set of one to twenty tabbed sheets.

Registering the number of divisions by one set of tabbed sheets in advance not only reduces the number of steps required for inputting one or more tabbed sheet feeding sections inserted in the copying machine body and the number of divisions by tabbed sheets in the tabbed sheet feeding section(s) when the tabbed sheets are copied, as described later, but also makes it possible to give a correct answer in response to a question asking how many tabbed sheets per set are inserted in which sheet feeding section, which is given from an apparatus on the network via the network communication I/F section 215.

Upon depression of the key 544 for closing the tabbed sheet division number input sub window 540 after setting the number of divisions by operating the minus key 541 and the plus key 542, the screen returns to the recording sheet type setting sub window 530. Further, upon depression of an OK key 536 on the recording sheet type setting sub window 530 after the input of the recording sheet type is completed, the set contents are registered and the screen returns to the common specification setting window 512.

If the set contents are not intended to be registered on the recording sheet type setting sub window 530, a cancel key 535 can be depressed to return the screen to the common specification setting window 512.

In this manner, the sheet feeding section(s) inserted in the copying machine and the number of divisions by tabbed sheets in the tabbed sheet feeding section(s) are registered in advance.

Figure 11:
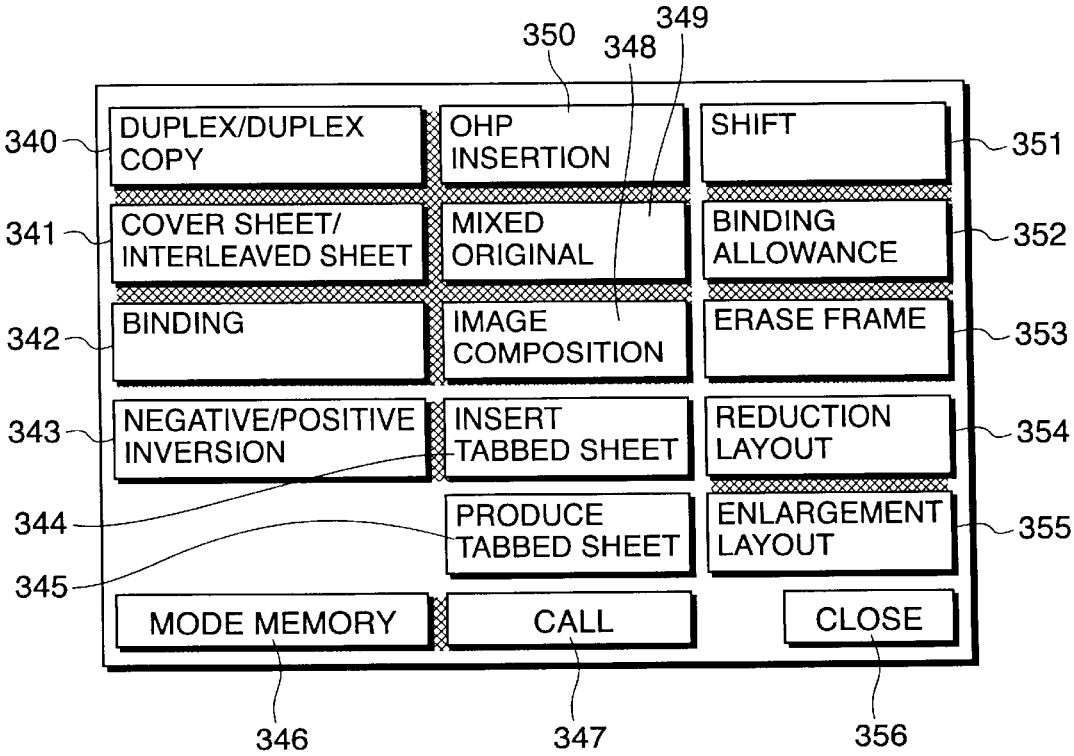
FIG. 11 is a diagram showing a sub window that is opened upon depression of an application mode key 311 in FIG. 9.

According to the present embodiment, if neither the sheet feeding section(s) nor the number of divisions by tabbed sheets is registered in advance, mode setting keys relating to tabbed sheets are not displayed on an application mode screen shown in FIG. 11 that is used to set a variety of modes for copying. Namely, a tabbed sheet insert mode key 344 and a tabbed sheet producing mode key 345 are not displayed on the screen in FIG. 11.

It should be noted that even if the tabbed sheet insert mode key 344 and the tabbed sheet producing mode key 345 are displayed on the screen in FIG. 11, they may be displayed in half-tone dot meshing or the like differently from other keys so that they cannot be selected even if they are depressed.

On the other hand, if the sheet feeding section(s) and the number of divisions by tabbed sheets in the sheet feeding section(s) are registered in advance, the tabbed sheet insert mode key 344 and the tabbed sheet producing mode key 345 are displayed as shown in FIG. 11 to enable settings relating to tabbed sheets to be set.

Figure 9:
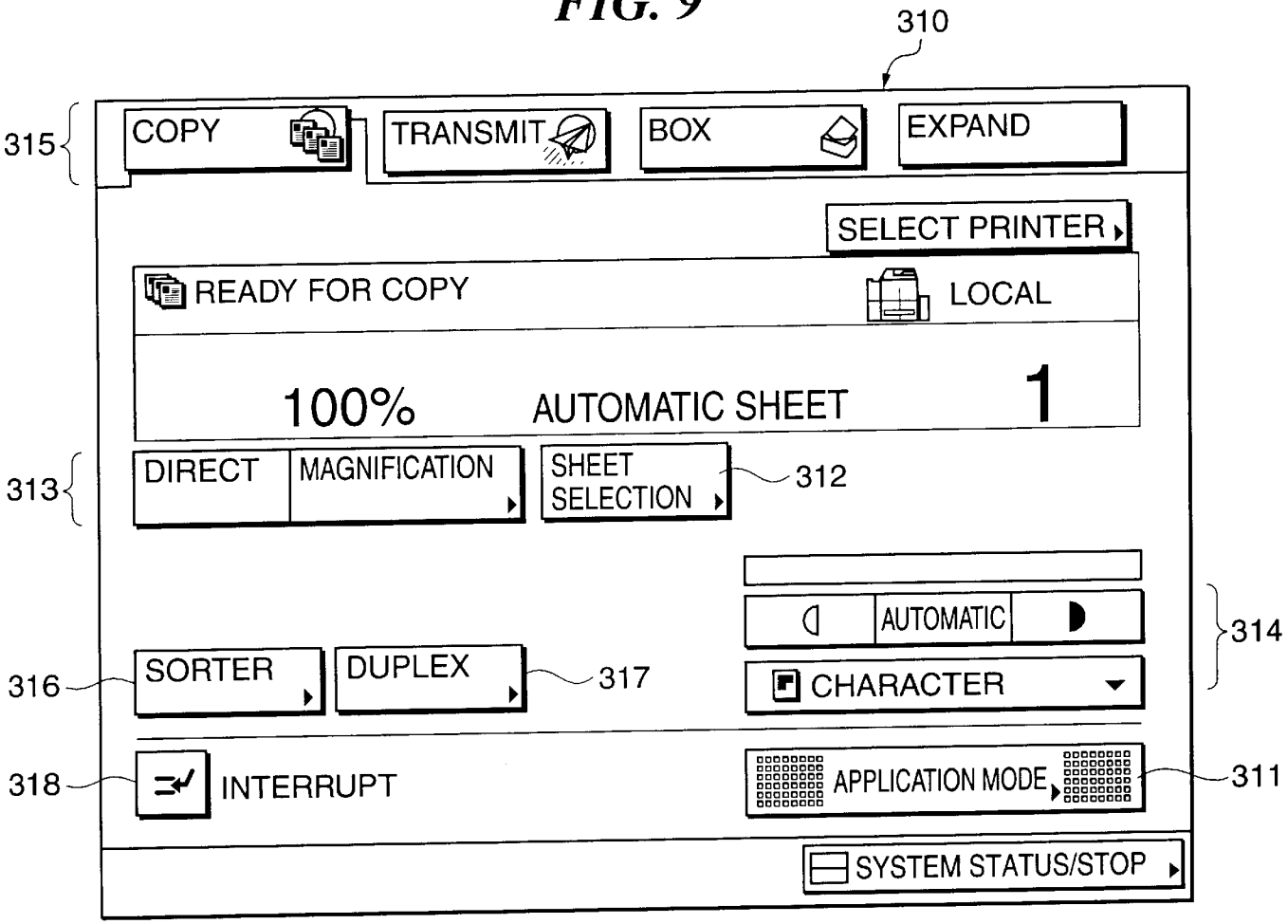
FIG. 9 is a diagram showing a standard screen that upon depression of a key 511 on a user mode window 500.
Figure 10:
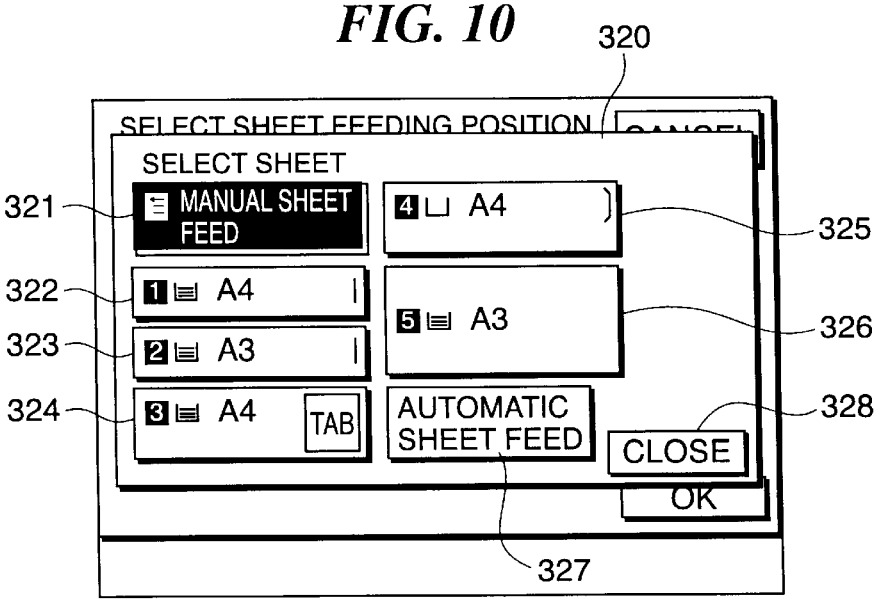
FIG. 10 is a sub window that is opened upon depression of a sheet feeding cassette selecting icon on the standard screen to select a sheet feeding cassette.

FIG. 9 through FIG. 11 illustrate a detailed example of the LCD display and input section 304 in FIG. 3. If on the user mode window 500 (refer to FIG. 4) the key 511 is depressed, the screen returns to the normal screen 310 in FIG. 9. The normal screen 310 shows icons for the application mode, and depression of the icons opens respective sub windows that are used to set a variety of modes.

Reference numeral 315 denotes a key group that is used to select functions of various jobs such as a copy function of copying an original, a transmission function of transmitting original image data to an apparatus on the network via the scan image converting section 213, the network communication I/F 215, or the like, a box function of storing original image data as image data in the HD 212 for printing, copying, transmission to an apparatus on the network via the scan image converting section 213 and the network communication I/F 215 later, and an expanding function such as a printing function of forming an image from image data transmitted from an apparatus on the network through the print image converting section 214 via the network communication I/F 215.

Reference numeral 312 denotes a sheet feeding section selecting icon, and depression of the icon 312 opens a sub window that is used to select the sheet feeding section as shown in FIG. 10 to enable display and selection of the sheet feeding section.

Reference numeral 314 denotes a key group that is used to select an image mode from among an automatic density correction mode, a character mode, a character photo mode, and a photo mode. If the character mode, character photo mode, or photo mode is selected, it is possible to change the density by operating a density key.

Reference numeral 313 denotes a key group that is used to change the magnification of the original, and includes a variety of keys such as a 100% copy key, a reduction key, an enlargement key, a zoom key for zooming while changing the magnification 1% by 1%, and a "fine reduction" key for copying the entire original. Whichever key is operated, the magnification of the original is changed. After the setting of the magnification, the set magnification is displayed. Reference numeral 316 denotes a sorter key that is used to set a finishing mode after recording sheets are outputted. Examples of the finishing mode are a sort mode applied when a plurality of sets of originals are intended to be outputted, a group sort mode in which one page of each original is outputted in the set number of copies, and a staple mode in which groups of recording sheets outputted in the sort mode are stapled on a group-by-group basis.

Reference numeral 317 denotes a duplex key that is used to set a variety of modes such as a mode in which one side or both sides of an original are read and a mode in which an image is outputted on one side or both sides of a recording sheet. Examples of the modes are a simplex/duplex mode in which one side of an original is read and outputted on both sides of a recording sheet, a duplex/duplex mode in which both sides of an original are read and outputted on both sides of a recording sheet, a duplex/simplex mode in which both sides of an original are read and outputted on one side of a recording sheet, and a duplex/duplex copy mode in which one side of an original is divided into two and the divided images are read and outputted on both sides of a recording sheet. Reference numeral 318 denotes an interrupt key that is used to interrupt a job, for example, in the case where another copy job is desired to be carried out when a large number of copies are being produced.

FIG. 10 illustrates a sub window that is displayed upon depression of the recording sheet selection key 312 shown in FIG. 9. The sub window in FIG. 10 is used to set a sheet feeding section that is selected from among the first sheet feeding cassette deck 121, second sheet feeding cassette deck 122, upper cassette 123, lower cassette 124, deck 150, and multi manual sheet feeding tray 154 of the image formation apparatus 100.

Reference numeral 321 denotes a key corresponding to the multi manual sheet feeding tray 154. Reference numeral 322 denotes a key corresponding to the first sheet feeding cassette deck 121 in which A4-size recording sheets are stored. Reference numeral 323 denotes a key corresponding to the second sheet feeding cassette deck 122 in which A3-size recording sheets are stored.

Reference numeral 324 denotes a key corresponding to the upper cassette 123, and in FIG. 10, the key 324 indicates that the upper cassette 123 is set as a tabbed sheet feeding section, i.e. A4-size tabbed sheets are stored in the upper cassette 123. This enables the user to recognize where tabbed sheets should be stored, or which cassette is set as the tabbed sheet feeding section.

Reference numeral 325 denotes a key corresponding to the lower cassette 124, and in FIG. 10, the key 325 indicates that the lower cassette 124 is selected for storing A4-size recording sheets but stores no recording sheet. Reference numeral 326 denotes a key corresponding to the deck 150, and in FIG. 10, the key 326 indicates that A3-size recording sheets are stored in the deck 150. Reference numeral 327 denotes an automatic sheet feed selection key. If the automatic sheet feed is selected by depressing the key 327, the optimum recording sheet size is detected according to the size of the original and the set copy mode, and if no optimum recording sheet size can be found, the second optimum recording sheet size is selected.

FIG. 11 illustrates a sub window that is displayed upon depression of an application mode key 311 in FIG. 9. A list of icons for setting copy modes is displayed on the sub window of FIG. 11.

Reference numeral 340 denotes a duplex/duplex copy key that is used to designate a mode in which the original is determined to be open and is divided into two to be read as two originals. Reference numeral 341 denotes a cover sheet/interleaved sheet key that is used to designate a mode in which a cover sheet, a back cover sheet, or an interleaved sheet as a dividing sheet is selected to output one copy. Reference numeral 342 denotes a binding mode key that is used to fold an output sheet copied from an original at the center and output the folded sheet just as a spread book. Reference numeral 343 denotes a negative/positive inversion key that is used to set a mode in which a white area of an image on an original is copied in black whereas a black area thereof is copied in white.

The tabbed sheet producing key 345 is used to set the tabbed sheet producing mode in which tabbed sheets are fed and an image corresponding to a tab portion, which is printed on an original, is moved to a position corresponding to the tab portion so that the image can be printed on the tab portion, in the case where there is provided the tabbed sheet feeding section such as the upper cassette 324 in FIG. 10.

The tabbed sheet insert key 344 is used to set the tabbed sheet insert mode in which tabbed sheets are used as dividing sheets such as interleaved sheets and images are shifted so that they can be printed on tabs, in the case where there is provided the tabbed sheet feeding section such as the upper cassette 324 in FIG. 10.

Reference numeral 346 denotes a mode memory key that is operated to store a variety of modes such as the application mode, the sort mode set by operating the key 316 (refer to FIG. 9), the magnification changing mode set by operating the key 315, and the image mode set by operating the key 314. Reference numeral 347 denotes a call key that is operated to call what is set in the previous copying operation. Reference numeral 348 denotes an image composition key that is operated to register a background image or output a background image registered in advance while lapping it over an original.

Reference numeral 349 denotes a mixed original key that is operated in the case where a plurality of originals are placed on the automatic original feeding device 180 with A4-size originals and A3-size originals being mixed. Reference numeral 350 denotes an OHP insertion key that is operated to feed OHP sheets from the multi manual sheet feed tray 154 or the like, printing images on the OHP sheets, and inserting plain recording sheets with the same images as those on OHP sheets printed thereon or with no image printed thereon between the OHP sheets.

Reference numeral 351 denotes a shift key that is operated to set the way of shifting an image on an original with respect to a recording sheet. Reference numeral 352 denotes a binding key that is operated to shift an image so as to form a binding allowance on an output sheet. Reference numeral 353 denotes a frame erasing key that is operated to erase an outside frame of an image on an original or erase an image of an outside frame on a recording sheet when printing. Reference numeral 354 denotes a reduction layout key that is operated to lay out and print images of a plurality of originals on a single recording sheet. Reference numeral 355 denotes an enlargement layout key that is operated to divide and print a plurality of images on a single recording sheet printed by operating the reduction layout key 354. Reference numeral 356 denotes a key that is used to close the sub window in the application mode so as to return to the normal screen 310.

Figure 12:
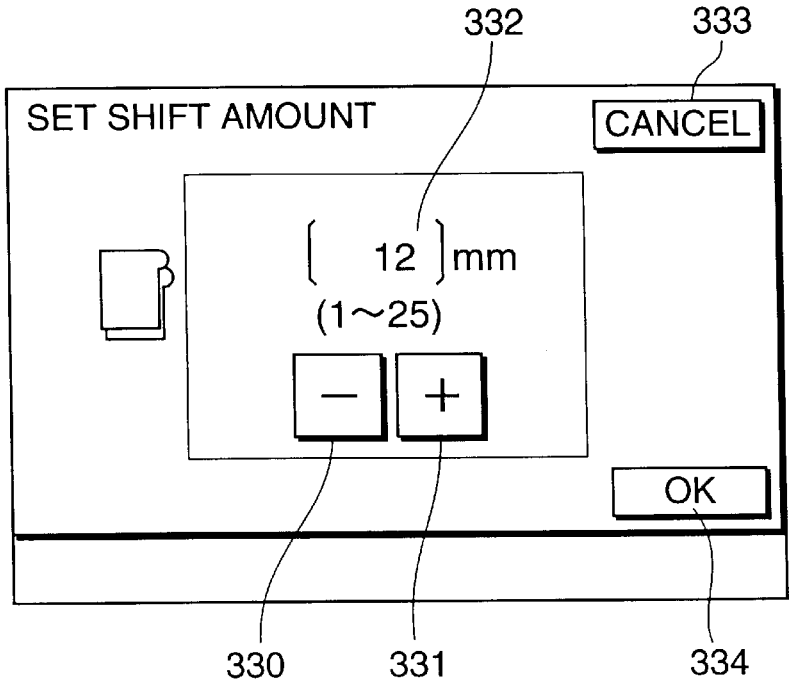
FIG. 12 is a diagram showing a sub window that is opened upon depression of a tabbed sheet producing key 345 or tabbed sheet insert key 354 in FIG. 11.

FIG. 12 illustrates a sub window that is opened upon depression of the tabbed sheet producing key 345 or tabbed sheet insert key 344 in FIG. 11. The sub window in FIG. 12 is used to set the shift amount of an image when a tabbed sheet is fed from the tabbed sheet feeding section to print an image on the tabbed sheet. The shift amount means an amount by which an image on an original to be printed on a tab portion of a recording sheet is shifted so that it can be printed on the tab portion as shown in FIG. 28. Ordinarily, an image is shifted by about 12 mm with respect to an A4-size recording sheet, but according to the present invention, the shift amount is changeable within a range between 0 mm and 25 mm depending upon the size of characters to be printed on a tab portion and the positions of characters on an original.

Reference numeral 330 denotes a minus key that is operated to reduce the shift amount, and reference numeral 331 denotes a plus key that is operated to increase the shift amount. Reference numeral 332 denotes an area where the shift amount intended to be set at present is displayed. Reference numeral 333 denotes a cancel key that is operated to cancel the set shift amount and make the screen return to the sub window (refer to FIG. 11) serving as the input screen for setting the number of divisions by tabbed sheets. Reference numeral 334 denotes an OK key that is operated to set the shift amount displayed in the area 332.

Figure 13:
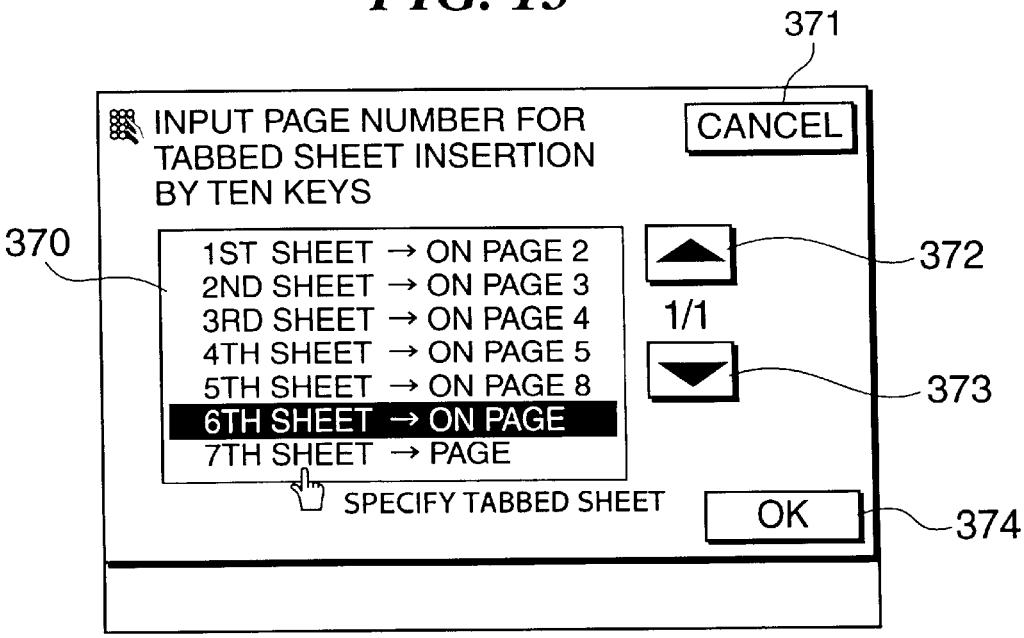
FIG. 13 is a diagram showing a display screen in a tab insert mode for setting insertion of tabbed sheets.

Upon depression of the OK key 334 in FIG. 12, a tabbed sheet insert mode screen is displayed as shown in FIG. 13. FIG. 13 illustrates a display screen in a tabbed sheet insert mode in which settings relating to the insertion of tabbed sheets are carried out. Reference numeral 370 denotes an insert page window indicating positions or pages where tabbed sheets are to be inserted. To select a first tabbed sheet, an area where the words "first sheet" are displayed is depressed, and a page number indicating a position where the first tabbed sheet is to be inserted is inputted by operating the ten keys 301. In the illustrated example, it is set that the first tabbed sheet is to be inserted "before page 2", and thus the first tabbed sheet is inserted between page 1 and page 2. Similarly, it is set that the second tabbed sheet is to be inserted between page 2 and page 3, the third tabbed sheet is to be inserted between page 3 and page 4, the fourth tabbed sheet is to be inserted between page 4 and page 5, and the fifth tabbed sheet is to be inserted between page 7 and page 8.

Reference numeral 371 denotes a cancel key that is operated to cancel the settings relating to the insertion of tabbed sheets. If the settings relating to the insertion of tabbed sheets are canceled, the screen returns to the sub window (FIG. 12) for setting the shift amount of an image to be printed on a tabbed sheet. Reference numeral 372 denotes a key that is used to scroll up the insertion page window 370 in the case where there are seven or more positions where tabbed sheets are to be inserted. Reference numeral 373 denotes a key that is used to scroll down the insertion page window 370 in the case where there are seven or more positions where tabbed sheet are to be inserted. Reference numeral 374 denotes an OK key that is used to carry out insertion of tabbed sheets into the positions set on the insert page window by a copy job, and depression of the OK key 374 completes the setting operation in the tabbed sheet insert mode.

The number of divisions by tabbed sheets, the shift amount of images to be printed on tabbed sheets, and the positions where tabbed sheets are to be inserted are set in the manner described above with reference to FIGS. 11 to 13.

Figure 14:
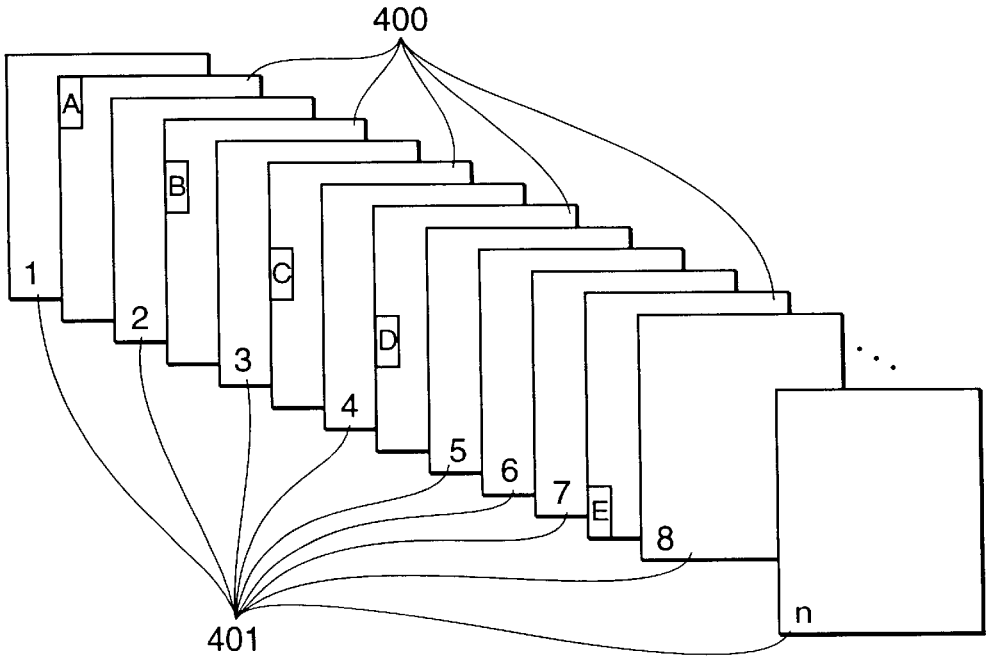
FIG. 14 is a diagram showing an example of arrangement of originals in the tabbed sheet insert mode.

FIG. 14 illustrates an example of arrangement of originals in the tabbed sheet insert mode.

Figure 15:
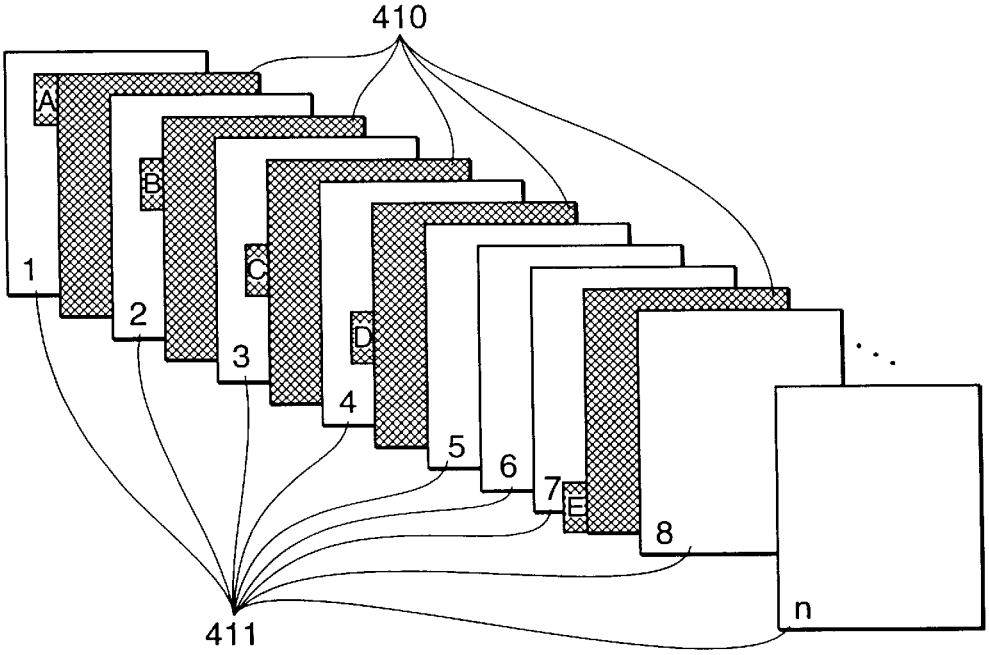
FIG. 15 is a diagram showing an example of arrangement of output sheets in the tabbed sheet insert mode.

FIG. 15 illustrates an example of arrangement of output sheets in the tabbed sheet insert mode. In the illustrated example, tab image originals 400 and tabbed sheets 410, on which images on the tab image originals 400 are to be printed, are identical with each other in size, but they are different only in that tabs project from the tabbed sheets 410. The tab image originals 400 are inserted between the tabbed sheets 410. The images on the tab image originals 400 are shifted by the set shift amount so that they are printed on the tabbed sheets 410.

Figure 16:
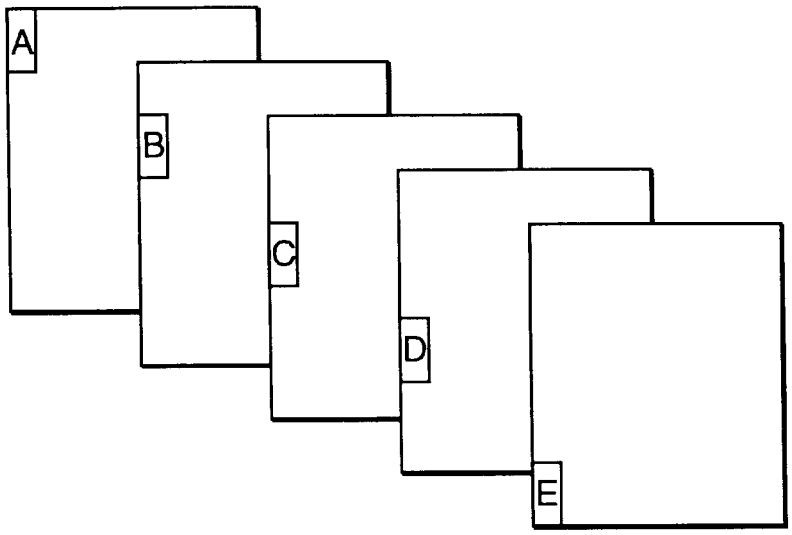

FIG. 16 illustrates an example of arrangement of originals in the tabbed sheet producing mode.

FIG. 17 illustrates an example of arrangement of output sheets on which images are formed in the tabbed sheet producing mode. The images printed on the tab image originals in FIG. 16 are shifted by the set shift amount so that they are printed on the tabbed sheets.

FIG. 18 shows changes in the screen in the tabbed sheet insert mode. Upon depression of the application mode key 311 on the normal screen 310 (refer to FIG. 9), an application mode screen 600 which is identical with the application mode screen (refer to FIG. 11) is displayed. Upon depression of a tabbed sheet insert key 601 on the application mode screen 600,a sub window (image shift amount sub window) 610 for setting the shift amount of an image to be printed on a tabbed sheet, which is identical with the image shift amount sub window (refer to FIG. 12) is displayed. On the image shift amount sub window 610, the number of divisions by one set of tabbed sheets is displayed in a division number display region 613. According to the present embodiment, a numeral "5" is displayed as the number of divisions by tabbed sheets since five tabbed sheets are included in one set. Upon depression of a cancel key 611, the screen returns to the application mode screen 600.

Upon depression of an OK key 612 on the image shift amount sub window 610, an insert page setting screen 620 which is identical with the sub window for setting insert pages (refer to FIG. 13) is displayed. Upon depression of the cancel key 621, the screen returns to the image shift amount sub window 610.

Upon depression of an OK key 622 on the insert page setting screen 620, the screen returns to the application mode screen 600. to complete the sequence of setting operations in the tabbed sheet insert mode. On this occasion, the screen may alternatively return to the normal screen 310. Upon depression of the cancel key 621 on the insert page setting screen 620, the screen returns to the sub window 610 for setting the shift amount of images to be printed on tabbed sheets.

FIG. 19 shows changes in the screen in the tabbed sheet producing mode. Upon depression of the application mode key 311 on the normal screen 310, an application mode screen 700 is displayed. Upon depression of a tabbed sheet producing key 701 on the application mode screen 700, an image shift amount sub window 710 is displayed. On the image shift amount sub window 710, the number of divisions by one set of tabbed sheets is displayed in a divide number display region 713. According to the present embodiment, a numeral "5" is indicated as the number of divisions by tabbed sheets as shown in FIG. 8 since five tabbed sheets are included in one set. Upon depression of a cancel key 711, the screen returns to the application mode screen 700. Upon depression of an OK key 712 on the image shift amount sub window 710, the screen returns to the application mode screen 700, to complete the sequence of the setting operations in the tabbed sheet producing mode. It should be noted that the screen may return to the normal screen 310 on this occasion.

The set information described above, e.g. the set information on the tabbed sheet feeding section and the number of divisions by tabbed sheets is stored even after the power supply is turned off.

In the above-described manner, the setting operations are carried out to execute the tabbed sheet insert mode in which images are printed on texts and tab portions of tabbed sheets at the same time in the case where tab image originals are inserted between originals and the mode in which images on tab image originals are copied on tab portions of tabbed sheets.

Referring next to FIGS. 20 and 21, a description will be given of a method of saving the set tabbed sheet feeding section and the set number of division by tabbed sheets in order to display the tabbed sheet insert mode and the tabbed sheet producing mode.

FIG. 20 is a schematic block diagram showing the circuit arrangement of the function control section 209 in FIG. 2. Reference numeral 1801 denotes a ROM that stores a control program executed by the function control section 209. When the power supply of the image forming apparatus body is turned on, the control program is expanded on a RAM 1802 and is executed by a CPU 1805. Reference numeral 1803 denotes a backup RAM that stores set data, which may be changed during execution of the program stored in the ROM 1801 and needs to be stored until the power supply is turned on next time. For example, the tabbed sheet feeding section and the number of divisions by tabbed sheets, and the like are stored in the backup RAM 1803, so that they can be read out when the power supply is turned on next time.

Although in the present embodiment, the backup RAM is used to store the set data, this is not limitative, but a readable and writable nonvolatile memory medium such as an EEPROM and a HDD may be used. Reference numeral 1804 denotes an operating section drive circuit that drives the operating section 219 in FIG. 2. The operating section drive circuit 1804 receives inputs from respective ones of keys 301–303 and 305 of the operating section 219 and sends the contents of inputs to the CPU 1805, or causes the operating section 219 to display data on the LCD display and input section 304 according to instructions from the CPU 1805.

Reference numeral 1806 denotes a network I/F drive circuit that drives the network communication I/F 215. The network I/F drive circuit 1806 receives data from a host computer connected thereto via the network. According to the type of the received data, the network I/F drive circuit 1806 changes settings so as to enable the print image converting section 214 to receive print image data, transmit a variety of data for the image forming apparatus body control section 200 stored in the function controls section 209, and transmit original images obtained by scanning by the original reading section 218 and stored in the image memory 208, as image data from the scan image converting section 213.

Reference numeral 1807 denotes a scan image converting section drive circuit that drives the scan image converting section 213. The scan image converting section drive circuit 1807 converts bitmap data of original images, which are obtained by scanning by the original reading section 218 and CCD 201, and temporarily stored in the image memory 208 through the image processing section 202 or which is obtained by expanding compressed image bitmap data stored in the HD 212 by the image data compressing and expanding section 207, into a predetermined format (such as JPEGF). Reference numeral 1808 denotes a print image converting section drive circuit that drives the print image converting section 214 to convert image data transmitted from a host computer received by the network I/F circuit into predetermined bitmap image data according to an instruction from the CPU 1805.

Referring to flow charts of FIGS. 21A and 21B, a description will now be given of the procedure for setting and storing the tabbed sheet feeding section and the number of divisions by tabbed sheets and enabling the tabbed sheet print mode such as the tabbed sheet insert mode and the tabbed sheet producing mode to be set and displayed in the LCD display and input section 304 on the operating section 219 using the above described circuit arrangement.

First, in a step S1901 in FIG. 21A, the power supply to the image forming apparatus body is turned on so that CPUs included in the body control section 200, original feeding device control section 216, post-processing device controls section 217, the HD control section 211, function control section 209, and the like operate to control various sections. Specifically, in the function control section 209 according to the present embodiment, the program data in the ROM 1801 is expanded onto the RAM 1802 and executed by the CPU 1805. In a step S1902, the backup data stored in the backup RAM 1803 is read out and a variety of setting items included in the image forming apparatus body control section 200 are set according to the backup data. In particular, the function control section 209 causes the operating section drive circuit 1804 to set a variety of modes for the operating section 219 that is controlled by the function control section 209.

In a step S1903, it is determined whether or not the backup data contains any backup data for setting the tabbed sheet feeding section relating to the tabbed sheet feeding section and the number of divisions by tabbed sheets as one of the setting items. If the backup data contains any backup data for setting the tabbed sheet feeding section, then in a step S1904 the operating section 219 is set via the operating section drive circuit 1804 such that the keys relating to the tabbed sheet print mode (i.e. tabbed sheet insert mode and tabbed sheet production mode) are displayed as shown in FIG. 11 when the application mode key 311 is depressed.

On the other hand, if the backup data does not contain any backup data for setting the tabbed sheet feeding section, in a step S1905 the operating section 219 is set via the operating section drive circuit 1804 such that the keys 344 and 345 relating to the tabbed sheet print mode (i.e. tabbed sheet insert mode and tabbed sheet production mode) in FIG. 11 are not displayed when the application mode key 311 is depressed. Thus, the initialization after the turning-on of the power supply in the step S1901 is completed and then the apparatus is brought into a standby state.

When the user mode key 305 on the operating section 219 is depressed in a step S1906 in FIG. 21B, the screen in FIG. 4 is displayed to urge the user to depress the common specification setting key 501 to display the screen in FIG. 5. To register the sheet type, the user depresses the sheet type registration key 513 in a step S1907 so that the screen in FIG. 6 is displayed. In a step S1908, a sheet feeding section in which tabbed sheets are to be stored is set. Since tabbed sheets are to be stored, the tabbed sheet key 534 is depressed on the screen in FIG. 7. In a step S1909, the number of divisions by tabbed sheets inputted via the operating section 219 is set, or a predetermined number of divisions by tabbed sheets is set when it is not inputted via the operating section 219. In a step S1910, the set or selected tabbed sheet feeding section and the number of divisions by tabbed sheets are stored as backup data in the backup RAM 1803.

Upon completion of the above operations, the operating section 219 is set via the operating section drive circuit 1804 such that the keys relating to the tabbed sheet print mode such as the tabbed sheet insert mode and the tabbed sheet producing modes can be displayed on the operating section 219.

If no sheet type is to be registered in the step S1907, other setting operations are carried out in a step S1912.

Setting operations of the setting information as described above are usually carried out in advance prior to the start of actual copying operations. According to the present embodiment, the setting information such as the tabbed sheet feeding section and the number of divisions by tabbed sheets is set in advance in the user mode, and the tabbed sheet print mode may be selected in response to the setting information being set in advance. Once the setting information is set, it can be used as it is to enable normal operation of the image forming apparatus to be carried out. That is, even if the power supply to the image forming apparatus body is turned off, the set information can be stored and held in the storage section so that the setting information before the turning-off of the power supply can be used as it is when the power supply is turned on again. This eliminates the necessity of inputting setting information every time the power supply is turned on, and makes the setting operations easier to improve the operability of the image forming apparatus.

A description will now be given of another embodiment of the present invention in which the keys 344 and 345 relating to the tabbed sheet print mode in FIG. 11 are displayed upon depression of the application mode key 311 irrespective of whether there is any information set in advance. More specifically, the tabbed sheet print mode is allowed to be selected, and only once in a sequence of operations for setting the tabbed sheet print mode, the tabbed sheet feeding section and the number of divisions are set. The set tabbed sheet feeding section and number of divisions are stored as described previously, and when the tabbed sheet print mode is set next time (from the second sequence of setting operations onward), the stored tabbed sheet feeding section and number of divisions are read out to thus eliminate the necessity of setting the tabbed sheet feeding sections and the number of divisions as in the case where the sheet feeding section and the number of divisions are set in advance.

Referring now to a flow chart of FIG. 29, a description will be given of the procedure for enabling the tabbed sheet print mode such as the tabbed sheet insert mode and the tabbed sheet producing mode to be set and displayed on the LCD display and input section 304 according to the present embodiment.

The operating section 219 is set in advance via the operating section drive circuit 1804 such that the keys relating to the tabbed sheet print mode can be displayed for selection as shown in FIG. 11 upon depression of the application mode key 311. Upon depression of the application mode key 311 in a step S2901 and the tabbed sheet insert mode key 344 or tabbed sheet producing mode key 345 in a step S2902, the backup data stored in the backup RAM 1803 is read out in a step S2903. It is determined in a step S2904 whether or not the set tabbed sheet feeding section and number of divisions by tabbed sheets are included in the backup data stored in the RAM 1803. If no set tabbed sheet feeding section is included in the backup data, the same screen as the one in FIG. 6 is displayed so as to allow the tabbed sheet feeding section to be selected and set in a step S2905. On the other hand, the sheet type registration screen in FIG. 7 may be omitted since tabbed sheets are to be stored. In a next step S2906, a predetermined number of divisions by tabbed sheets is set via the operating section 219. In a step S2907, the selected tabbed sheet feeding section and the set number of divisions by tabbed sheets per set are stored as backup data in the backup RAM 1803. In a step S2908, the operating section 219 is set in advance such that the number of divisions by tabbed sheets can be displayed on the tabbed sheet print mode setting screen as indicated in the division number display region 613 on the screen 610 in FIG. 18. In a step S2909, the sub window (refer to FIGS. 12 and 13) for setting the shift amount of images to be printed on tabbed sheets and insert pages therefor is displayed to allow the tabbed sheet print mode to be set.

If it is determined in the step S2904 that there is any backup data relating to the set tabbed sheet feeding section and number of divisions by tabbed sheets (if the setting operations in the steps S2905 through S2907 have already been carried out), that is, if the tabbed sheet print key is depressed for the second time onward, the tabbed sheet feeding section setting operation in the step S2905 or the tabbed sheet division number setting operation in the step S2906 are not carried out, but in the step S2908, the operating section 219 is set via the operating section drive circuit 1804 such that the number of divisions by tabbed sheets can be displayed on the tabbed sheet print mode setting screen as indicated in the division number display region 613 on the screen 610 in FIG. 18.

Therefore, when setting the tabbed sheet print mode next time, there is no need for setting the tabbed sheet feeding section or the number of divisions by tabbed sheets since they have already been stored as backup data in the backup RAM 1803. That is, in the tabbed sheet insert mode, for example, the screen is changed in the same manner as in FIG. 18 without displaying the screens in FIGS. 6, 7 and 8.

It should be noted that in the case where tabbed sheets are stored in a plurality of sheet feeding sections, it is necessary to designate one of these sheet feeding sections from which tabbed sheets are to be fed and this applies to all of the embodiments. Even in this case, the number of divisions by tabbed sheets has been set for each of the sheet feeding sections, and therefore, there is no need for setting the number of divisions by tabbed sheets again when setting the tabbed sheet print mode. Therefore, there is no requirement for setting at least the number of divisions by tabbed sheets, i.e. the number of tabbed sheets per set.

A description will now be given of a method of setting the tabbed sheet print mode and a method of acquiring information on tabbed sheets when a host computer causes the image forming apparatus according to the present invention to print out tabbed sheets in the tabbed sheet print mode.

First, when the host computer is a personal computer (PC), ordinarily, it is provided with software for exclusive use in image forming apparatuses. This software is generally called a "printer driver". A special printer driver is also prepared for the image forming apparatus according to the present embodiment so as to set a variety of functions such as a stapling function and a duplex printing function. In the following, a detailed description will now be given of a manner of issuing a request for information on the tabbed sheet feeding section and the number of divisions by tabbed sheets, to the image forming apparatus according to the present embodiment using software (printer driver) of the host computer for exclusive use in the image forming apparatus.

FIG. 22 illustrates an example of connection between the image forming apparatus 100 and host computers (PC1, PC2, PC3, PC4) via the network. The image forming apparatus and the host computers can be connected to each other via the network, and each host computer can acquire internal data stored in the image forming apparatus body 100 through the network I/F drive circuit 1806 via the I/F network communication I/F 215. Examples of the internal data are operational information data stored in the RAM 1802 and a variety of setting data stored in the backup RAM 1803, which can be transmitted to respective ones of the host computers. To print out images by the image forming apparatus, each host computer causes the above-mentioned printer driver to set a printing mode executable by the image forming apparatus.

Since the image forming apparatus according to the present invention is capable of feeding tabbed sheets, each host computer selectively display or not display the setting items relating to the tabbed sheet print mode and set the setting items on the printer driver according to data on the set tabbed sheet feeding section and number of divisions by tabbed sheets, which is stored in the image forming apparatus. FIGS. 23A and 23B show a flow chart showing the procedure for acquiring tabbed sheet feeding section information in the image forming apparatus and the printer driver. FIG. 23A is a flow chart showing the procedure for providing information by a data presenting section, not shown, which presents data included in the function control section 209 that operates the image forming apparatus body 100, to host computers connectable to the image forming apparatus on the network via the network communication I/F 215.

The flow chart of FIG. 23 describes in detail only a method of presenting information relating to tabbed sheets. In a step S2100, the power supply to the image forming apparatus is turned on or the apparatus is initialized, and programs stored in the function control section 209 are started, and programs stored in the data presenting section are expanded onto the RAM 1802 to start the operation. In a step S2101, initializations are carried out in order to present data information required by the host computers via the network communication I/F 215. Then, in a step S2102, a request for information on the sheet feeding section from any of the host computers is waited for.

If one of the host computers outputs a request for acquiring information on the sheet feeding section, the sheet feeding section information stored in the image forming apparatus body is set to the network communication I/F 215 via the network I/F drive circuit 1806. In a step S2104, it is determined whether or not information on the tabbed sheet feeding section is included in the sheet feeding section information. If the information on the tabbed sheet feeding section is found, the already set number of divisions by tabbed sheets stored in the tabbed sheet feeding section is set in a step S2105. The process then proceeds to a step S2106 wherein the information on the number of divisions by tabbed sheets is set to the network communication I/F via the network I/F drive circuit 1806 so that the information is transmitted to the host computer as the sender of the request.

Although in the above described flow of operations, the sheet feeding section information is transmitted to the host computer that sent the request, this is not limitative, but the sheet feeding section information relating to the sheet feeding section in which tabbed sheets are stored and the number of divisions by the tabbed sheets may be set to the network communication I/F 215 via the network I/F drive circuit 1806 so that the host computers connected to the network communication I/F can acquire the sheet feeding section information as the need arises.

On the other hand, the printer driver of the host computer that sent the request for the sheet feeding section information displays a printer driver screen on the host computer as shown in FIG. 24, and acquires the sheet feeding section information and sets and displays the tabbed sheet mode according to a flow of operations as shown in FIG. 23B.

Further, although in the present embodiment, the image forming apparatus communicates with the host computers via the network, the present invention encompasses a case in which one PC and one image forming apparatus are connected to each other.

FIG. 24 illustrates an example of the printer driver that is used to execute the operations of the flow chart according to the present embodiment. Reference numeral 2200 denotes a printer driver screen that is used for setting items relating to the sheet feed executed by the printer driver and is displayed when the printing function of the image forming apparatus according to the present embodiment is set as shown in FIG. 24 in response to a printing instruction from the host computer. In FIG. 24, a sheet feed setting tag 2202 is depressed. In addition to the sheet feed setting tag 2202, a page setting tag 2201 that is depressed to set the page size and the enlargement/reduction rate, a finishing setting tag 2203 that is depressed to set a staple mode, a binding mode, and the like in the post-processing device 190, a device setting tag 2204 that is depressed to set a variety of equipment in the image forming apparatus body 100 or acquire information, and so forth are displayed on the screen.

Reference numeral 2205 denotes the display showing the sheet feed sections for feeding the text of a print when setting sheet-feed related items. To cause the control section 200 of the image forming apparatus body 100 to automatically select the sheet feeding section, a row "auto" 2206 is selected. Sheet feeding sections to be set indicated by reference numerals 2207, 2208, 2209, 2210, 2211 correspond, respectively, to the sheet feeding sections 121, 122, 123, 124, 150, 154 in FIG. 1.

If the tabbed sheet is designated for a cassette 3 corresponding to the upper cassette 223 of the image forming apparatus body 100 as indicated by the reference numeral 2210, it is possible to feed tabbed sheets and what is set in the row 2210 is independently displayed as a tabbed sheet feeding section as indicated by reference numeral 2212 so that the user can select the tabbed sheet feeding section. Reference numeral 2213 denotes an indication of the tabbed sheet producing mode that is made effective upon selection of the tabbed sheet feeding section indicated in the column 2212. Specifically, the tabbed sheet producing mode is made effective upon depression of a check box at the left side thereof, and corresponds to the tabbed sheet producing key 345 in the copy mode in FIG. 11.

Reference numeral 2214 denotes a tabbed sheet insert mode that is made effective upon selection of the tabbed sheet feeding section indicated in the block 2212. Specifically, the tabbed sheet insert mode is made effective upon depression of a check box at the left side thereof, and corresponds to the tabbed sheet insert key 344 in the copy mode in FIG. 11. In FIG. 24, the check box at the left side of the indication of the tabbed sheet insert mode is highlighted in black so as to indicate that the tabbed sheet insert mode has been set.

Reference numeral 2215 denotes the display showing the set tabbed sheet insert pages, which is made effective upon selection of the tabbed sheet insert mode 2214. Since the cassette 3 is set for storing five sheets per set in the row 2210, the insert pages can be set for five pages. Page numbers in which tabbed sheets are to be inserted can be set in rows 2216, 2217, 2218, 2219, 2220.

In the illustrated example, the first tab is inserted on page 1 of the text, the second tab is inserted on page 10 of the text, the third tab is inserted on page 15 of the text, the fourth tab is inserted on page 25 of the text, and the fifth tab is inserted on tab 30 of the text. Reference numeral 2221 denotes an OK key that is depressed to make effective all the setting items displayed on the printer driver screen. Reference numeral 2222 denotes a key that is used to cancel the items set on the printer driver screen to return the settings to defaults that is not described in detail herein.

Referring next to FIG. 23B, a description will be given of the flow of setting and displaying operations carried out by the printer driver. A power supply switch of the host computer (PC) is depressed in a step S2110, and the host computer waits in a step S2111 until any of a variety of applications gives an instruction for printing to the image forming apparatus according to the present embodiment. Upon output of the instruction for printing, the host computer is connected to the image forming apparatus having received the instruction, according to an IP address and the like set in advance therefor, in a step S2112.

Information on the sheet feeding section in the image forming apparatus is acquired in a step S2113, and it is determined in a step S2114 whether or not there is a tabbed sheet feeding section. If there is a tabbed sheet feeding section, it is indicated that the sheet feeding section is to feed tabbed sheets as shown in the row 2210 showing the cassette 3 as the sheet feeding section on the sheet feeding section display 2205 in FIG. 24. Further, in a step S2116, the sheet feeding selection selectable for feeding tabbed sheets is displayed as in the row 2212 to enable selection of the tabbed sheet feeding section that is to used to print images on tabbed sheets. On the tabbed sheet feeding section display 2212, the number of divisions by tabbed sheets set in the image forming apparatus (five in this example) is displayed at the same time, and this is reflected in the number of pages (2216, 2217, 2218, 2219, 2220) displayed in the insert page setting display 2215. If there is no tabbed sheet feeding section, no setting item relating to tabbed sheets is displayed in a step S2115 as shown in FIG. 25, and the process returns to the step S2111.

The data relating to the tabbed sheet feed set by the user is processed by the steps S2116 et seq. in the case where there is a tabbed sheet feeding section in the image forming apparatus. In the step S2116, the tabbed sheet feeding section and the number of divisions by tabbed sheets are displayed, and it is then determined in a step S2117 whether or not the type of sheets to be fed is the tabbed sheet.

If the user sets the type of sheets to be fed to the tabbed sheet, he or she sets pages on which tabbed sheets are to be inserted in a step S2118, and this is repeated until the user finishes setting the tabbed sheet inserting pages (step S2119). Upon completion of the setting operation, it is determined in a step S2120 whether there are any extra tabs or not, from the set numbers of pages and the acquired number of divisions by tabbed sheets.

The "extra tabs" means as follows: For example, if only three pages for which tabbed sheets are to be fed are set in the case where five tabbed sheets are included in one set, tabbed sheets for two pages are left as "extra tabs".

FIG. 26 illustrates an example of display on the printer driver in the case where only two pages for which tabbed sheets are to be fed are set. As indicated in rows 2401 and 2402, the insert pages are set for the first and second tabbed sheets, but no insert page is set for other tabbed sheets. If an operator of the host computer depresses an OK key on this occasion, extra tabs are generated.

If it is determined in the step S2120 that there are any extra tabs, a warning message indicating the presence of extra tabs is displayed in the form of a dialog as shown in FIG. 27 on the host computer. In a step S2122, information indicating the number of tabbed sheets to be fed is transmitted to the image forming apparatus, which was connected to the host computer in the step S2112 and is used for printing.

As described hereinabove, the execution of the program in the data presenting section included in the function control section 209 enables transmission of required data to the host computer connected to the tabbed sheet feeding section via the network, and the host computer can also carry out printing images on the tabbed sheets while recognizing the tabbed sheet feeding section and the number of divisions by tabbed sheets set in the image forming apparatus body.

More specifically, if the tabbed sheet feeding section and the number of divisions by tabbed sheets are set in the image forming apparatus, information on these settings is displayed on the printer driver screen to enable easy acquisition of accurate tabbed sheet setting information and enable execution of the tabbed sheet print mode by the host computer.

Although a warning message indicating the presence of extra tabs is displayed on the host computer in the above embodiment, this is not limitative, but a warning message indicating the presence of extra tabs may be displayed on the LCD display and input section 304 of the operating section 219.

Further, since the number of extra tabs can be accurately recognized, in addition to displaying the warning message, tabbed sheets corresponding in number to the number of extra tabs may be automatically discharged to the outside of the image forming apparatus to eliminate the need for taking out the extra tabbed sheets by the user, and this further improves the operability of the image forming apparatus.

That is, since the tabbed sheet feeding section and the number of divisions by tabbed sheets are set in advance, the setting operations can be carried out easier in the tabbed sheet insert mode and the tabbed sheet producing mode to improve the operability, and in addition, automatically discharging extra tabbed sheets further improves the operability without requiring the user to take out extra tabbed sheets.

As described in detail hereinabove, the image forming apparatus according to the present invention is capable of presetting the tabbed sheet feeding section and the number of divisions of recording sheets by tabbed sheets to make the setting operations easier in the tabbed sheet insert mode and the tabbed sheet image formation mode during image formation to thus improve the operability of the image forming apparatus.

What is claimed is:

1. An image forming apparatus comprising:

a plurality of sheet feeding sections, at least one of which stores tabbed sheets each having a tab projecting from one edge thereof;

an image forming section that forms images on the tabbed sheets;

a mode setting section that sets a tabbed sheet print mode in which said image forming section forms an image on the tab of each of the tabbed sheets; and a control section responsive to the at least one sheet feeding section and a number of the tabbed sheets per set being set in advance, for enabling said mode setting section to set the tabbed sheet print mode, and responsive to the at least one sheet feeding section and the number of the tabbed sheets per set not being set in advance, for disabling said mode setting section to set the tabbed sheet print mode.

2. An image forming apparatus according to claim 1, further comprising a sheet feeding setting section that sets the at least one of said sheet feeding sections that stores the tabbed sheets, and a sheet number setting section that sets the number of the tabbed sheets per set stored in said at least one sheet feeding section.

3. An image forming apparatus according to claim 2, wherein said control section is responsive to the at least one sheet feeding section being set in advance by said sheet feeding setting section and the number of the tabbed sheets per set being set in advance by said sheet number setting section, for providing control so as to display an input screen for setting the tabbed sheet print mode.

4. An image forming apparatus according to claim 3, wherein said control section provides control so as not to display an input screen for setting the tabbed sheet print mode when none of said sheet feeding sections that stores the tabbed sheets is set in advance by said sheet feeding setting section and the number of the tabbed sheets per set is not set in advance by said sheet number setting section.

5. An image forming apparatus according to claim 4, wherein the input screen includes a key for setting the tabbed sheet print mode.

6. An image forming apparatus according to claim 4, wherein said control section provides control so as to display a predetermined number of tabbed sheets per set on a screen displayed in the tabbed sheet print mode without requesting setting of the number of the tabbed sheets per set.

7. An image forming apparatus comprising:

a plurality of sheet feeding sections, at least one of which stores tabbed sheets each having a tab projecting from one edge thereof;

an image forming section that forms images on the tabbed sheets; and a mode setting section that sets a tabbed sheet print mode in which the image forming section forms an image on the tab of each of the tabbed sheets;

wherein said mode setting section omits a request for setting at least a number of the tabbed sheets per set in setting the tabbed sheet print mode when the at least one sheet feeding section and a number of the tabbed sheets per set are set in advance before setting the tabbed sheet print mode, and requests setting of at least the number of the tabbed sheets per set in setting the tabbed sheet print mode when said at least one said sheet feeding section and the number of the tabbed sheets per set are not set in advance before setting the tabbed sheet print mode.

8. An image forming apparatus according to claim 7, further comprising a sheet feeding setting section that sets the at least one sheet feeding section, and a sheet number setting section that sets the number of the tabbed sheets per set stored in the at least one sheet feeding section.

9. An image forming apparatus according to claim 8, further comprising a storage section that stores the at least one of the sheet feeding sections that stores the tabbed sheets and the number of the tabbed sheets per set, set in response to the request by said mode setting section in setting the tabbed sheet print mode.

10. An image forming apparatus according to claim 9, wherein when setting of the number of the tabbed sheet per set is requested in setting the tabbed sheet print mode, said mode setting section omits a request for setting at least the number of the tabbed sheets per set in setting the tabbed sheet print mode next time.

11. An image forming apparatus according to claim 8, further comprising a control section that displays the set number of the tabbed sheets per set on a setting screen in the tabbed sheet print mode.

12. A method of controlling an image forming apparatus that forms images on tabbed sheets each having a tab projecting from one edge thereof, comprising the steps of:

setting a sheet feeding section that stores the tabbed sheets;

setting a number of the tabbed sheets per set;

setting a tabbed sheet print mode in which an image is formed on the tab of each of the tabbed sheets;

enabling the tabbed sheet print mode to be set, in response to the sheet feeding section that stores the tabbed sheets and the number of the tabbed sheets per set being set in advance; and disabling the setting of the tabbed sheet print mode, in response to the sheet feeding section that stores the tabbed sheets and the number of the tabbed sheets per set being not set in advance.

13. A method of controlling an image forming apparatus that forms images on tabbed sheets each having a tab projecting from one edge thereof, comprising the steps of:

setting a sheet feeding section that stores the tabbed sheets;

setting a number of the tabbed sheets per set;

setting a tabbed sheet print mode in which an image is formed on the tab of each of the tabbed sheets;

omitting a request for setting at least the number of the tabbed sheets per set in setting the tabbed sheet print mode when the sheet feeding section that stores the tabbed sheets and the number of the tabbed sheets per set are set in advance; and requesting setting of at least the number of the tabbed sheets per set in setting the tabbed sheet print mode when the sheet feeding section that stores the tabbed sheets and the number of the tabbed sheets per set are not set in advance.

14. A storage medium storing a computer readable program for forming images on an image forming apparatus on tabbed sheets each having a tab projecting from one edge thereof, the program comprising instructions for:

setting a sheet feeding section that stores the tabbed sheets;

setting a number of tabbed sheets per set;

setting a tabbed sheet print mode in which an image is formed on the tab of each of the tabbed sheets;

determining whether the sheet feeding section that stores the tabbed sheets and the number of the tabbed sheets per set are set in advance; and displaying a tabbed sheet print mode setting screen when the sheet feeding section and the number of the tabbed sheets per set are set in advance, and not displaying the tabbed sheet print mode setting screen when the sheet feeding section and the number of the tabbed sheets per set are not set in advance.

15. An image forming apparatus comprising a sheet feeding section which stores tabbed sheets each having a tab projecting from one edge therof, an image forming section that forms images on the tabbed sheets;

a mode setting section that sets a tabbed sheet print mode in which said image forming section forms an image on the tab of each of the tabbed sheets; and a control section responsive to a number of the tabbed sheets per set being set in advance, for enabling said mode setting section to set the tabbed sheet print mode, and responsive to the number of the tabbed sheets per set not being set in advance, for disabling said mode setting section to set the tabbed sheet print mode.

16. An image forming apparatus comprising:

a sheet feeding section which stores tabbed sheets each having a tab projecting from one edge thereof;

an image forming section that forms images on the tabbed sheets; and a mode setting section that sets a tabbed sheet print mode in which the image forming section forms an image on the tab of each of the tabbed sheets;

wherein said mode setting section omits a request for setting at least a number of the tabbed sheets per set in setting the tabbed sheet print mode when the number of the tabbed sheets per set is set in advance before setting the tabbed sheet print mode, and requests setting of at least the number of the tabbed sheets per set in setting the tabbed sheet print mode when the number of the tabbed sheets per set is not set in advance before setting the tabbed sheet print mode.

17. A method of controlling an image forming apparatus that forms images on tabbed sheets each having a tab projecting from one edge thereof, comprising the steps of:

setting a number of the tabbed sheets per set stored in a sheet feeding section;

setting a tabbed sheet print mode in which an image is formed on the tab of each of the tabbed sheets;

enabling the tabbed sheet print mode to be set when the number of the tabbed sheets per set is set in advance; and disabling setting of the tabbed sheet print mode when the number of the tabbed sheets per set is not set in advance.

18. A method of controlling an image forming apparatus that forms images on tabbed sheets each having a tab projecting from one edge thereof, comprising the steps of:

setting a number of the tabbed sheets per set stored in a sheet feeding section;

setting a tabbed sheet print mode in which an image is formed on the tab of each of the tabbed sheets;

requesting setting of the number of the tabbed sheets per set in setting the tabbed sheet print mode when the number of the tabbed sheets per set is not set in advance; and omitting a request for setting the number of the tabbed sheets per set in setting the tabbed sheet print mode when the number of the tabbed sheets per set is set in advance.

19. A storage medium storing a computer readable program for forming images on an image forming apparatus on tabbed sheets each having a tab projecting from one edge thereof, the program comprising instructions for:

setting a number of the tabbed sheets per set stored in a sheet feeding section;

setting a tabbed sheet print mode in which an image is formed on the tab of each of the tabbed sheets;

determining whether the number of the tabbed sheets per set are set in advance; and displaying a tabbed sheet print mode setting screen when the number of the tabbed sheets per set is advance, and not displaying the tabbed sheet print mode setting screen when the number of the tabbed sheets per set is not set in advance.

20. An image forming apparatus comprising:

a plurality of sheet feeding sections, at least one of which stores tabbed sheets each having a tab projecting from one edge thereof;

an image forming section that forms images on the tabbed sheets;

a mode setting section that sets a tabbed sheet print mode in which said image forming section forms an image on the tab of each of the tabbed sheets;

a sheet feeding setting section that sets the at least one of said sheet feeding sections that stores the tabbed sheets;

a sheet number setting section that sets a number of the tabbed sheets per set stored in said sheet feeding section; and a control section responsive to the at least one sheet feeding section which stores the tabbed sheets and the number of the tabbed sheets per set being set in advance, for enabling said mode setting section to set the tabbed sheet print mode, and responsive to the at least one sheet feeding section which stores the tabbed sheets and the number of the tabbed sheets per set not being set in advance, for disabling said mode setting section to set the tabbed sheet print mode.

* * * * *